US008715144B1

(12) United States Patent
Friess et al.

(10) Patent No.: US 8,715,144 B1
(45) Date of Patent: May 6, 2014

(54) PORTABLE EXERCISE PLATFORM WITH RESISTANCE MECHANISMS

(75) Inventors: John Friess, Portland, OR (US); Chris Gunson, Eugene, OR (US); Robert Montgomery, Portland, OR (US)

(73) Assignee: Journey Fitness LLC, Portland, OR (US)

( * ) Notice: Subject to any disclaimer, the term of this patent is extended or adjusted under 35 U.S.C. 154(b) by 619 days.

(21) Appl. No.: 12/970,916

(22) Filed: Dec. 16, 2010

Related U.S. Application Data

(63) Continuation-in-part of application No. 12/559,466, filed on Sep. 14, 2009, now Pat. No. 7,946,969, and a continuation of application No. 29/324,516, filed on Sep. 12, 2008, now Pat. No. Des. 610,638.

(60) Provisional application No. 61/096,721, filed on Sep. 12, 2008.

(51) Int. Cl.
*A63B 21/02* (2006.01)

(52) U.S. Cl.
USPC ..... 482/123; 482/121; 482/126

(58) Field of Classification Search
USPC ..... 482/51, 52, 120–123, 126–130, 140, 1, 482/42, 148, 910
See application file for complete search history.

(56) References Cited

U.S. PATENT DOCUMENTS

| | | | |
|---|---|---|---|
| 1,518,361 | A | 12/1924 | Ruden |
| 2,097,273 | A | 10/1937 | Feist |
| 3,664,666 | A | 5/1972 | Lloyd |
| 3,893,667 | A | 7/1975 | Snyder, Jr. et al. |
| 4,018,189 | A | 4/1977 | Umphries et al. |
| 4,089,520 | A | 5/1978 | Ozbey et al. |
| 4,269,150 | A | 5/1981 | McCarthy |
| 4,333,638 | A | 6/1982 | Gillotti |
| 4,478,413 | A | 10/1984 | Siwula |
| 4,645,204 | A | 2/1987 | Berger |
| 4,984,785 | A | 1/1991 | Wilkinson |
| 5,261,864 | A | 11/1993 | Fitzpatrick |
| D355,458 | S | 2/1995 | Chen |
| 5,431,617 | A | 7/1995 | Rattray, Jr. |
| 5,454,771 | A | 10/1995 | Wilson-Hyde |
| 5,474,509 | A | 12/1995 | Hodgdon |
| 5,514,057 | A | 5/1996 | Ciolino |
| D371,177 | S | 6/1996 | Efobi |
| 5,540,642 | A | 7/1996 | Sprague |
| 5,551,934 | A | 9/1996 | Binette |
| 5,697,870 | A | 12/1997 | Osborn |
| 5,890,456 | A | 4/1999 | Tancrede |
| 5,974,979 | A | 11/1999 | Grady et al. |
| 6,000,346 | A | 12/1999 | Pajerski et al. |
| 6,245,001 | B1 | 6/2001 | Siaperas |
| 6,299,569 | B1 | 10/2001 | Rich |
| 6,315,701 | B1 | 11/2001 | Shifferaw |

(Continued)

*Primary Examiner* — Glenn Richman
(74) *Attorney, Agent, or Firm* — Law Office of Karen Dana Oster, LLC

(57) ABSTRACT

A portable exercise platform described herein has at least one platform section with at least one longitudinal resistance mechanism and at least one latitudinal resistance mechanism. Preferred embodiments include a split longitudinal resistance mechanism and an interwoven latitudinal resistance mechanism. The split longitudinal resistance mechanism includes first and second parts, each part being attached to at least one platform section and having a plurality of resistance bands. The interwoven latitudinal resistance mechanism includes first and second parts, each part being attached to at least one platform section and having a plurality of resistance bands. Preferred embodiments include retractable handgrips, each handgrip having an extendable-retractable strap, each of the plurality of resistance bands suitable for directly or indirectly (via a spreader attachment device) attaching to the extendable-retractable strap.

22 Claims, 18 Drawing Sheets

(56) References Cited

U.S. PATENT DOCUMENTS

| | | | |
|---|---|---|---|
| 6,558,301 | B1 | 5/2003 | Jackson |
| D482,748 | S | 11/2003 | Flynt |
| 6,659,922 | B1 | 12/2003 | Yu |
| 6,705,234 | B1 | 3/2004 | Miller et al. |
| 6,845,736 | B1 | 1/2005 | Anderson |
| 6,908,417 | B2 | 6/2005 | Jackson |
| 7,040,257 | B2 | 5/2006 | Waxman et al. |
| D533,667 | S | 12/2006 | Roleder |
| 7,168,393 | B2 | 1/2007 | Bogdahn et al. |
| 7,172,540 | B2 | 2/2007 | Nguyen |
| 7,217,227 | B2 | 5/2007 | Finn |
| 7,250,021 | B2 | 7/2007 | Leight |
| 7,431,681 | B1 | 10/2008 | St. Cyr |
| 7,637,855 | B2 | 12/2009 | Bizzell et al. |
| 2003/0114278 | A1 | 6/2003 | Rigas |
| 2006/0128540 | A1 | 6/2006 | Engle |
| 2007/0087920 | A1 | 4/2007 | Dachraoui et al. |

PORTABLE EXERCISE PLATFORM WITH RESISTANCE MECHANISMS

The present application is a continuation-in-part of U.S. patent application Ser. No. 12/559,466 (Now U.S. Pat. No. 7,946,969), filed Sep. 14, 2009. U.S. patent application Ser. No. 12/559,466 is an application claiming the benefit under 35 USC Section 119(e) of U.S. Provisional Patent Application Ser. No. 61/096,721, filed Sep. 12, 2008. U.S. patent application Ser. No. 12/559,466 is a continuation of U.S. Design patent application Ser. No. 29/324,516 (now U.S. Design Pat. No. D610,638), filed Sep. 12, 2008. The present application is based on and claims priority from these applications, the disclosures of which are hereby expressly incorporated herein by reference.

BACKGROUND OF INVENTION

The present invention is directed to a portable exercise platform and, more particularly, to a portable exercise platform with resistance mechanisms.

Previous exercise platform devices can generally be divided into two categories: (1) systems using static extensions, springs, and pulleys, and (2) systems using resistive elements attached directly to the exterior of an exercise platform. The references discussed below are herein incorporated by reference in their entirety.

U.S. Pat. No. 4,478,413 to Siwula and U.S. Pat. No. 3,664,666 to Lloyd represent the category of systems that use static extensions, springs, and pulleys.

U.S. Pat. No. 4,478,413 to Siwula describes a torsion-type device that includes three sections hinged to each other in a manner that allows the device to be folded and unfolded. One of the sections contains an adjustable torsion spring mechanism connected to pulleys, cables, and handgrips fashioned in a manner to offer adjustable resistance to a user's muscular movements as he pulls on the handgrips. This described system is complicated and includes many parts. Further, these parts are also expensive to replace if they wear out or break.

U.S. Pat. No. 3,664,666 to Lloyd describes a folding portable case, suitcase, or the like that may be opened to fold out a three-section exercise platform. Spring loaded cables provide for various types of lifting, pulling, and pushing exercises. This described system is complicated and unwieldy. Further, there are many parts, including pulleys, cables, and bracing mechanisms for supporting the platform at various angles. Still further, these parts are also expensive to replace if they wear out or break.

U.S. Pat. No. 6,558,301 to Jackson, U.S. Pat. No. 6,245,001 to Siaperas, and U.S. Patent Publication No. 2007/0087920 to Dachraoui represent the category of systems that use resistive elements attached directly to a platform.

U.S. Pat. No. 6,558,301 to Jackson describes an exercise apparatus that includes an exercise platform having a base and lid, the platform defining an interior space accessible by moving the lid from a closed to an open position with respect to the base. Resistive elements may be selectively attached to mounts on the platform for use in an exercise by a user. A handgrip is attached to the free end of the resistive element.

U.S. Pat. No. 6,245,001 to Siaperas describes a multipurpose exercise device that has a generally rectangular, boxlike main body. The top surface of the body is hinged transversely to create a storage container and an adjustable section that can be fixed at various angles in relation to the main body by using a pivotal adjustment arm extending the bottom of the boxlike body. In the first embodiment, a plurality of clip rings is provided along both the sides of the boxlike main body and a depending inner lip of the adjustable upper section. The user may attach resistive elements to various ones of these clip rings to allow for a wide variety of different exercises. Handgrips are attached to the free ends of the resistive elements.

U.S. Patent Publication No. 2007/0087920 to Dachraoui describes a portable exercise device that has a generally rectangular, box-like main body in two platform portions, hinged together for opening and closing, and having a storage area within. The platform portions each include recessed areas for attaching resistive tubing. Handgrips or a press bar are attached to the free ends of the resistive tubing.

The devices described in U.S. Pat. No. 6,558,301 to Jackson, U.S. Pat. No. 6,245,001 to Siaperas, and U.S. Patent Publication No. 2007/0087920 to Dachraoui all suffer from similar problems. For example, each of these devices is significantly limited in that most resistive elements would not be suitable for a serious exercise aficionado who required more resistance. Put another way, a "buff user" would not be challenged by a single resistive element. Further, almost every exercise performed using these devices would require different resistive elements either because the resistance would need to be changed (requiring the user to keep low, medium, and high resistive elements with them if they wanted a complete workout) or because the length of the resistive element would need to be changed between exercises. Finally, it should be noted that one set of resistive elements would not be able to accommodate multiple users if the users had different heights and/or strength.

It should be noted that many prior art devices, including some of those discussed above, suffer from additional problems.

For example, one problem shared by some devices/methods is that they only have the ability to exercise one area of the body or major muscle group, and are designed for such. For example U.S. Pat. No. 7,217,227 to Finn is a portable exercise device, but is limited to exercises in which the muscles of the back are primarily targeted. Similarly, U.S. Pat. No. 7,172,540 to Nguyen is a portable exercise device, but its purpose is to only isolate the abdominal muscles. In each case, a full body workout where all major muscle groups are targeted is highly unlikely.

Yet another problem shared by many prior art devices/methods is that they may not provide a specific and isolated cardiovascular workout other than the inherent cardiovascular benefits the user may gain through any resistance workout.

BRIEF SUMMARY OF THE INVENTION

The present invention is directed to a portable exercise platform and, more particularly, to a portable exercise platform with resistance mechanisms.

Preferred embodiments of the present invention are directed to a portable exercise platform having at least one platform section. Alternatively, preferred embodiments of the present invention are directed to a portable exercise platform having at least two platform sections connected by a mechanism for connecting them in an open condition and in a closed condition.

Preferred embodiments of the present invention include at least one longitudinal resistance mechanism attached to at least one platform section, the at least one longitudinal resistance mechanism having a plurality of resistance bands. The invention also includes at least one latitudinal resistance mechanism attached to at least one platform section, the at least one latitudinal resistance mechanism having a plurality of resistance bands.

Preferred embodiments of the present invention include a first part of a resistance mechanism attached to at least one platform section and second part of a resistance mechanism attached to at least one platform section. The first and second parts of the resistance mechanism each have a plurality of resistance bands.

Preferred embodiments of the present invention include a split longitudinal resistance mechanism and an interwoven latitudinal resistance mechanism. The split longitudinal resistance mechanism includes first and second parts, each part being attached to at least one platform section and having a plurality of resistance bands. The interwoven latitudinal resistance mechanism includes first and second parts, each part being attached to at least one platform section and having a plurality of resistance bands.

Preferred embodiments include retractable handgrips, each handgrip having an extendable-retractable strap, each of the plurality of resistance bands suitable for directly or indirectly (via a spreader attachment device) attaching to the extendable-retractable strap.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings, that are incorporated in and constitute a part of this specification, illustrate various exemplary embodiments.

DETAILED DESCRIPTION OF THE INVENTION

Figure 1:
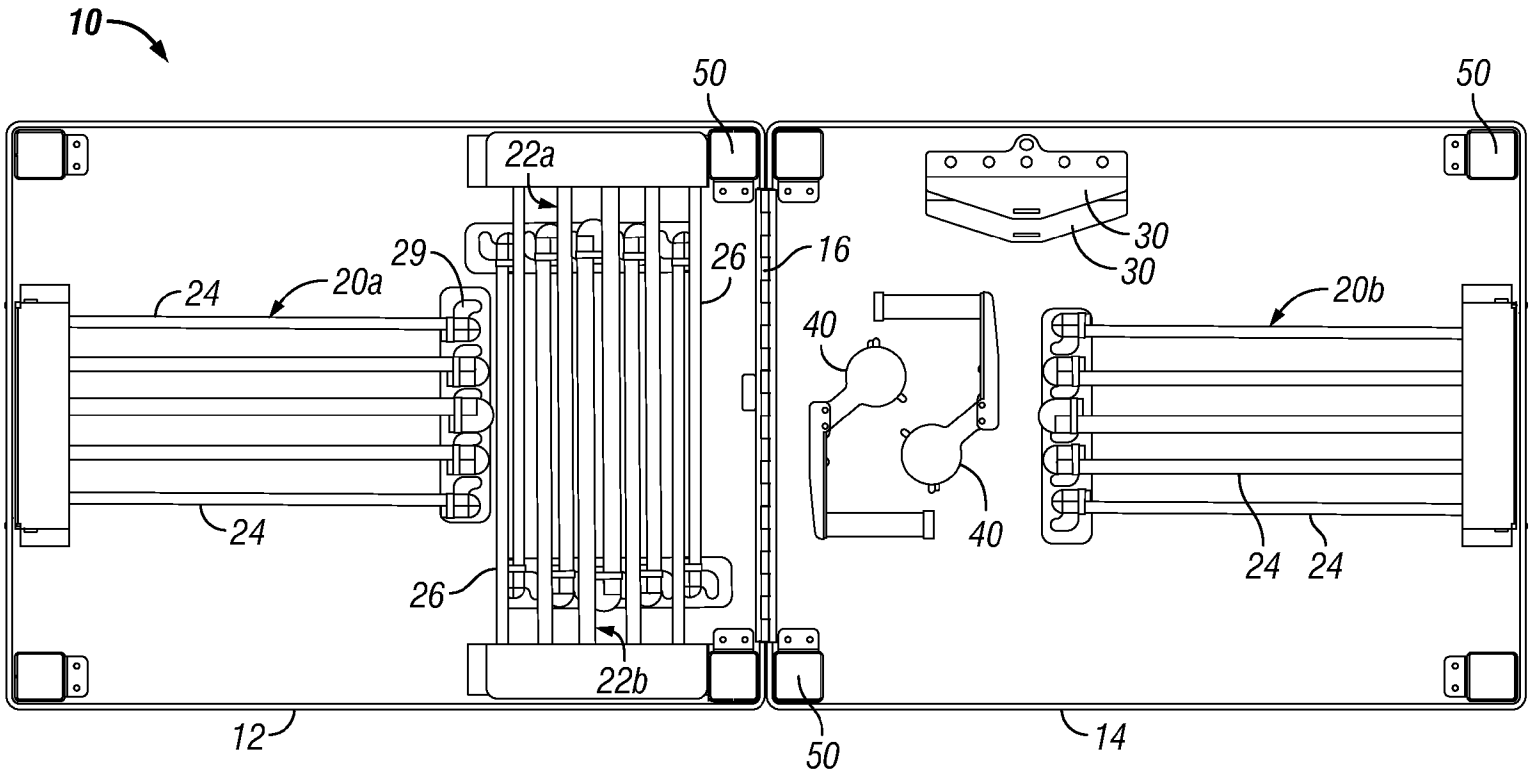
FIG. 1 is a bottom plan view of two exemplary platform sections of the exercise platform of a first exemplary preferred embodiment of the present invention in the open condition showing exemplary longitudinal resistance mechanisms, exemplary latitudinal resistance mechanisms, exemplary handgrips, and exemplary spreaders stored within the exercise platform.
Figure 2:
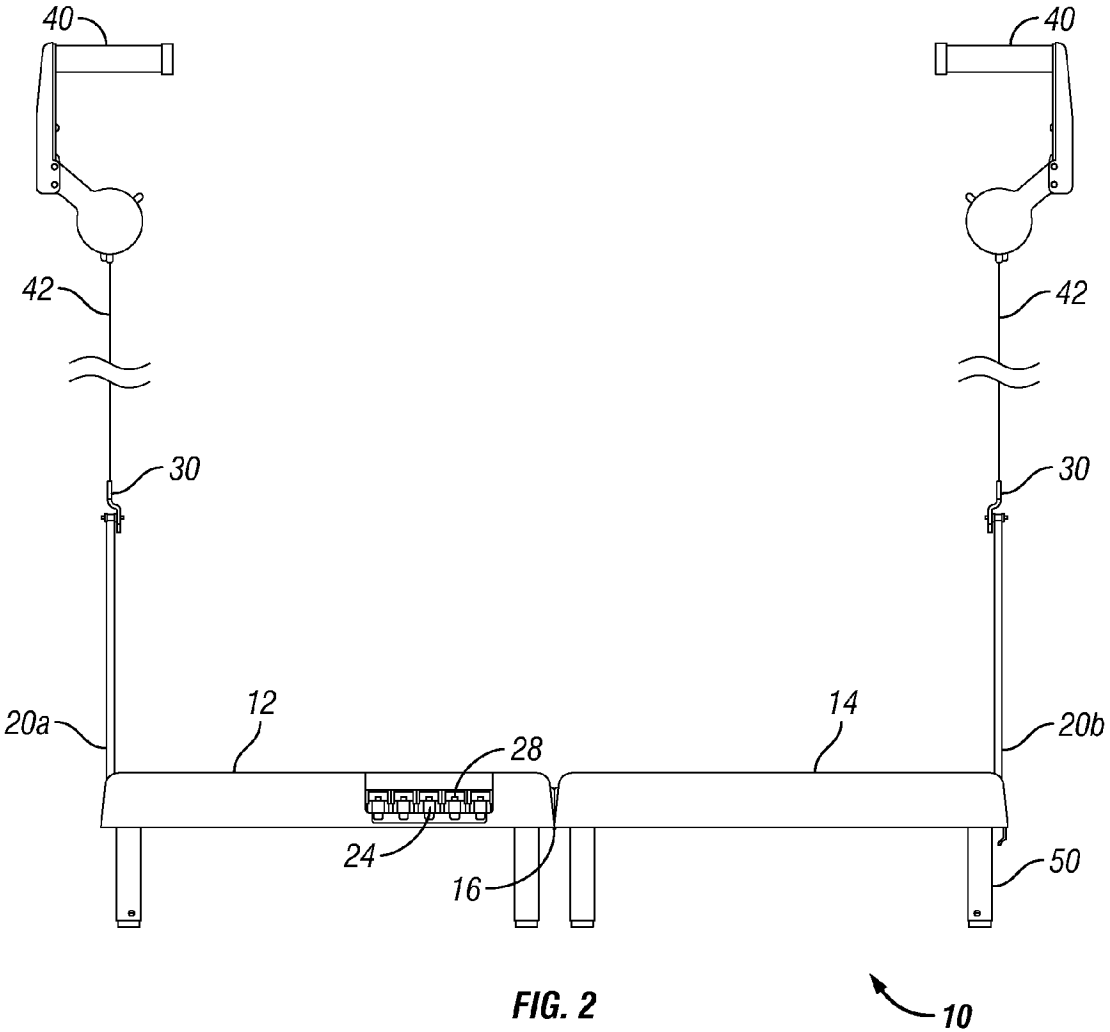
FIG. 2 is a front view of the first exemplary preferred embodiment of the exercise platform of the present invention in the open condition with the legs extended and with the exemplary handgrips attached to the exemplary longitudinal resistance mechanisms.
Figure 3:
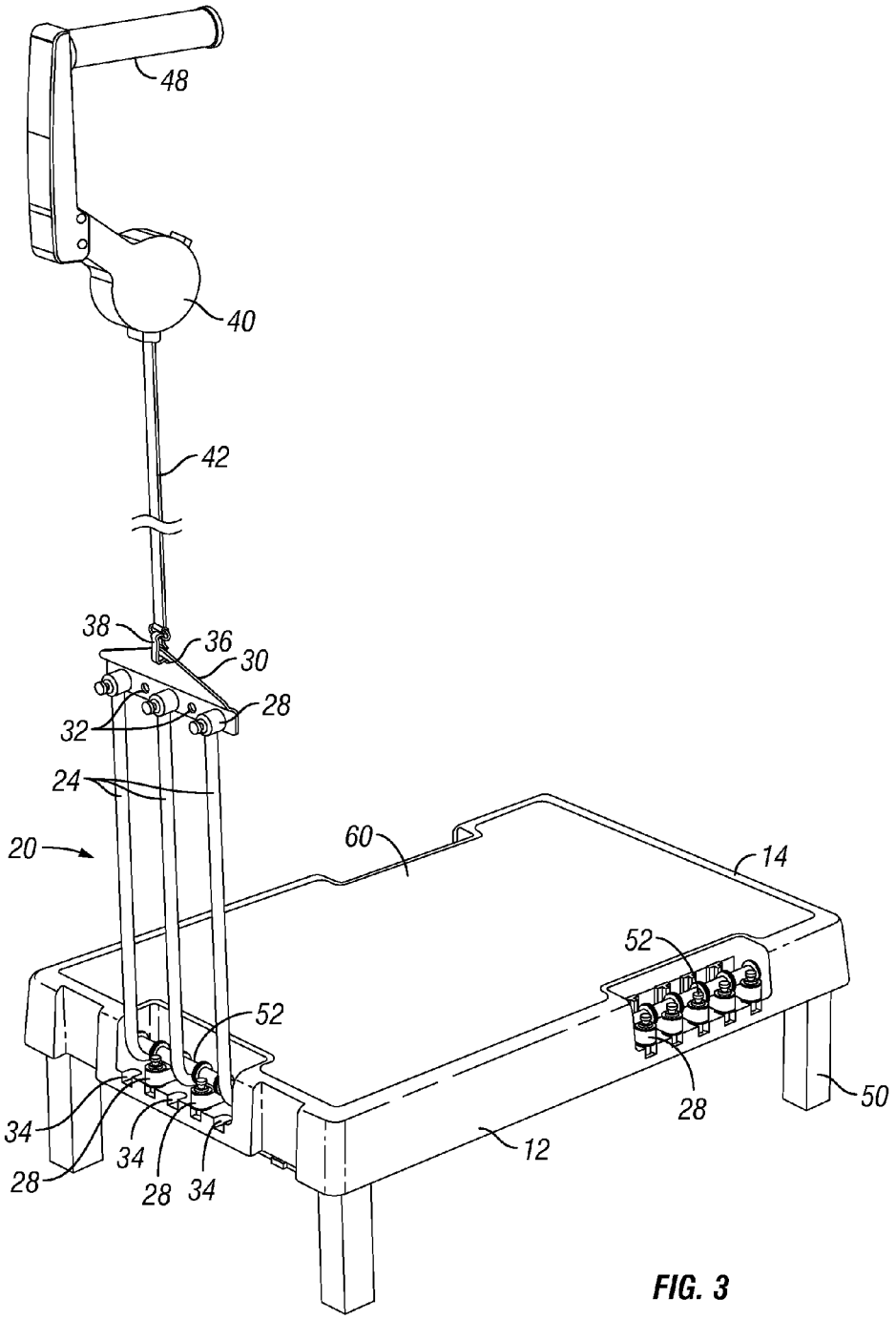
FIG. 3 is an enlarged detailed view of an exemplary longitudinal resistance mechanism in which only three resistance bands are attached to their three respective connection components on the exemplary spreader that is, in turn, connected to the extendable-retractable strap of the handgrip.
Figure 4:
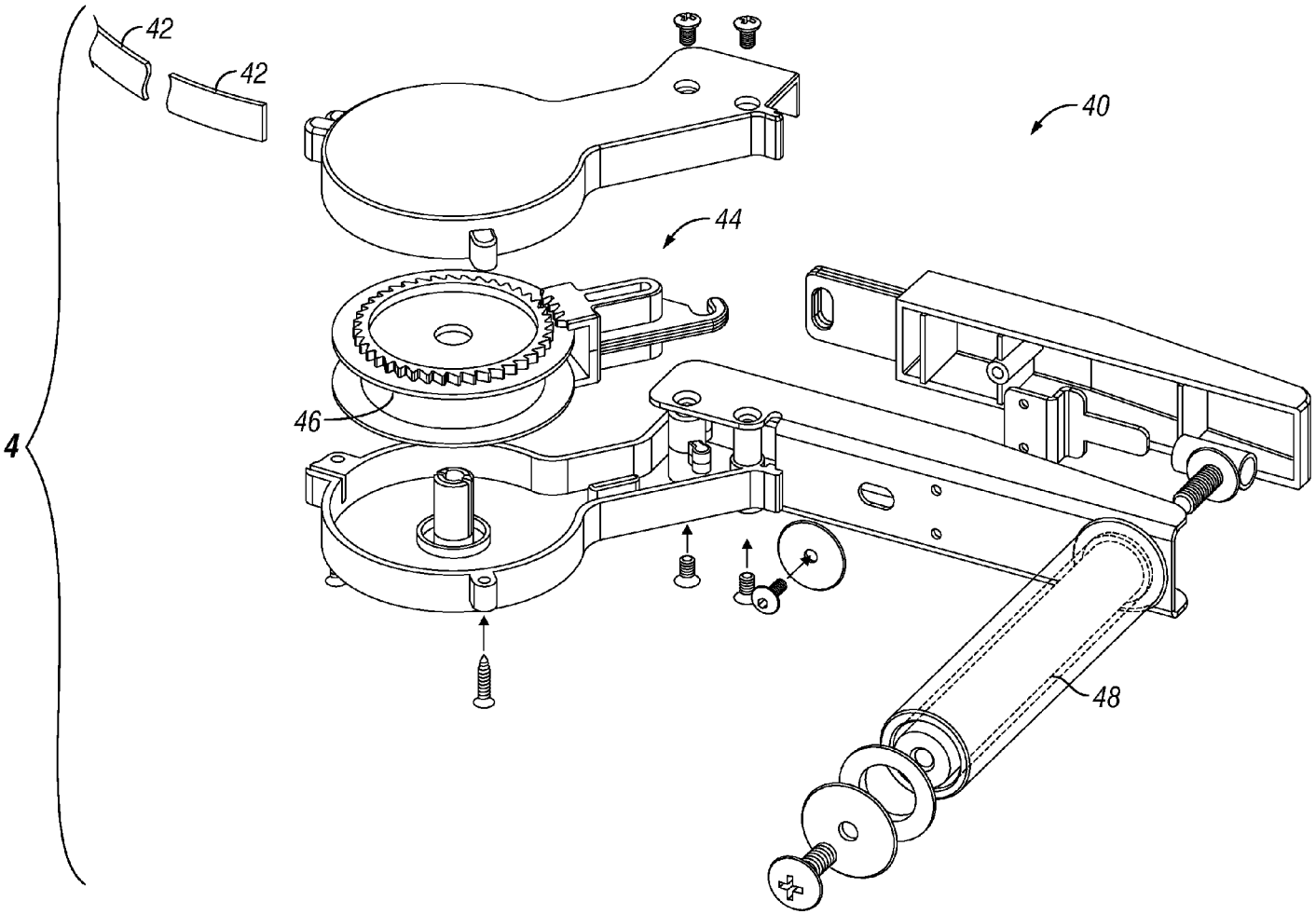
FIG. 4 is a detailed exploded view of an exemplary handgrip of the present invention.
Figure 5:
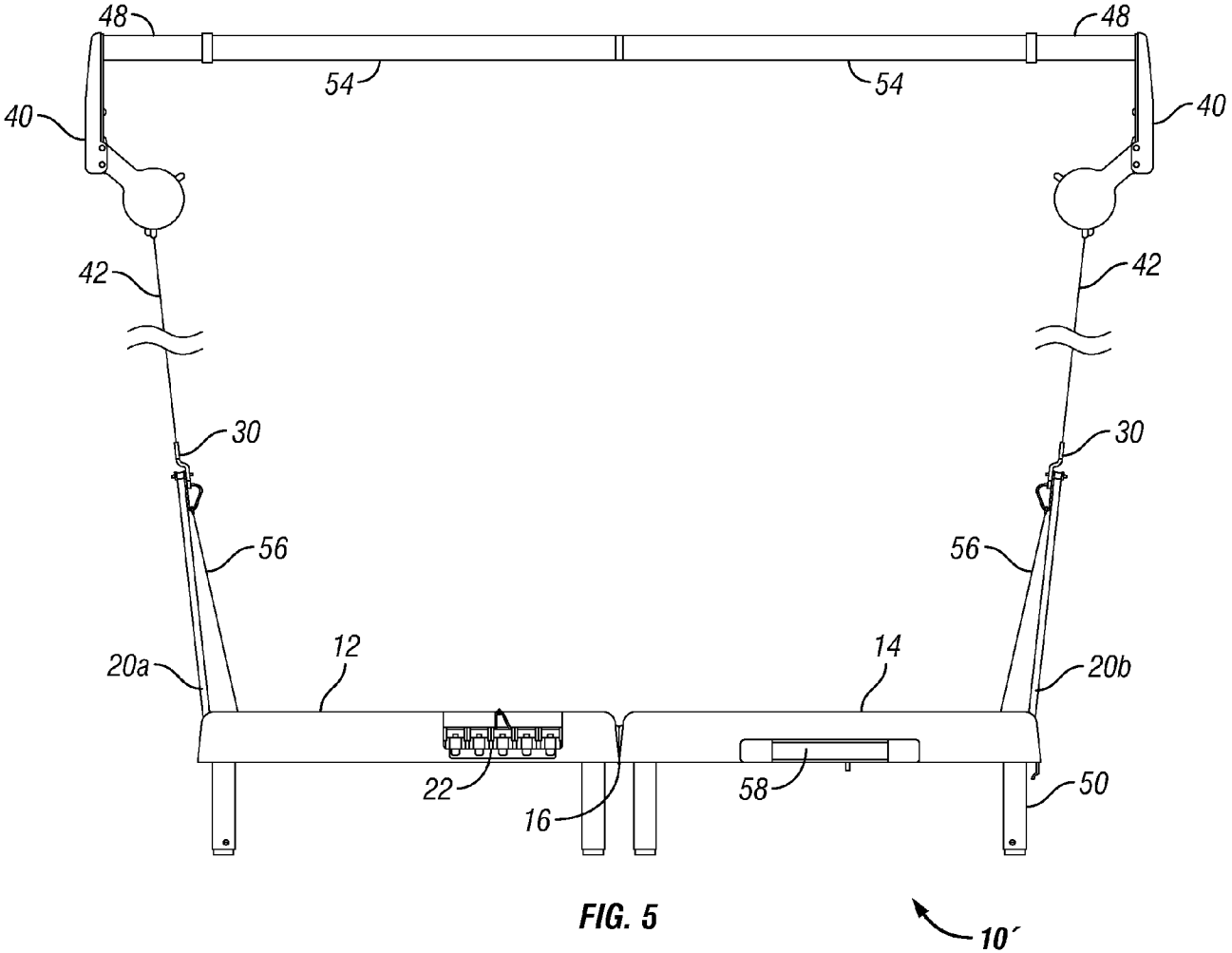
FIG. 5 is a front view of a second exemplary preferred embodiment of an exercise platform of the present invention in the open condition with the legs extended and with the exemplary handgrips attached to the exemplary longitudinal resistance mechanisms, this second embodiment including a carrying handle and limiter lines, and this figure showing an optional removable handgrip connection shaft.
Figure 26:
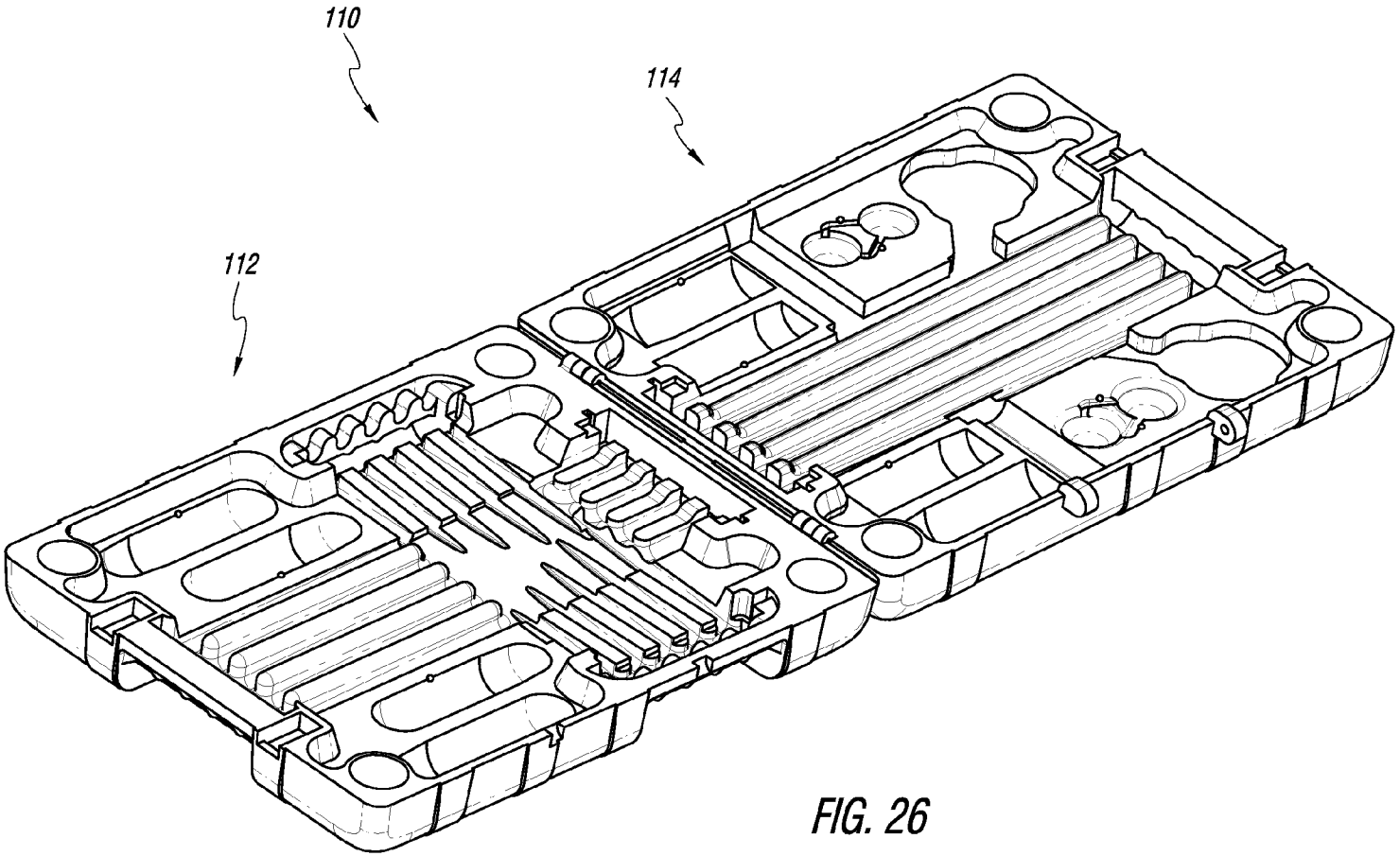
FIG. 26 is a bottom perspective view of two exemplary platform sections of the exercise platform of a fourth exemplary preferred embodiment of the present invention in the open condition.

The present invention is directed to a portable exercise platform 10 that has two "halves" or platform sections 12, 14 that can be positioned selectively between an open condition and a closed condition. (A first preferred embodiment of the portable exercise platform 10 is shown in FIGS. 1 and 2, a second preferred embodiment of the portable exercise platform 10' is shown in FIG. 5, a third preferred embodiment of the portable exercise platform 10" is shown in FIGS. 6-13, and a fourth preferred embodiment of the portable exercise platform 110 is shown in FIG. 26. The embodiments will be referred to generally as exercise platform 10.) As shown in FIGS. 1 and 2, preferably two sets of resistance mechanisms are used: a two-part longitudinal (lengthwise) resistance mechanism 20*a*, 20*b* (referred to generally as the longitudinal resistance mechanism 20) and a latitudinal (crosswise) resistance mechanism 22 (that includes two "sides" 22*a*, 22*b* that are interwoven/alternating). As shown in FIG. 3, in preferred embodiments each resistance mechanism 20, 22 includes a plurality of resistance bands 24, 26, and each resistance band 24, 26 has a first part of a connection component (shown as thimble 28) substantially at an end thereof. Each thimble 28 may be removably attached to a spreader attachment device (referred to generally as spreader 30), and particularly to a second part of the connection component (shown as an aperture or hole 32 defined in the spreader 30). The spreader 30 is, in turn, connected to a unique handgrip 40 (shown in detail in FIGS. 4 and 23-25) via an extendable-retractable strap 42.

The Exercise Platform, Internal Framework, and Cover(s)

As set forth above, preferred embodiments of the exercise platform 10 have two "halves" or platform sections 12, 14 that are preferably hingedly (e.g. using a hinge 16) connected so that they can transition between a closed (portable) condition (shown in FIG. 13) and an open (working) condition. In the closed condition, the exterior of the platform sections 12, 14 form a shell or case in which the internal components of the system are enclosed and/or in which accessories may be stored. In the open condition, the platform sections 12, 14 function as an exercise platform 10. For purposes of this description, the platform may be described as a "case" when it is in the closed condition. In some embodiments, an internal framework (internal structure) is used to reinforce the platform/case (e.g. the support bar 15 shown in FIGS. 6 and 8). In preferred embodiments the platform sections 12, 14 have an aesthetically pleasing design such as that shown and described in U.S. Design patent application Ser. No. 29/324,516 (now U.S. Design Pat. No. D610,638), that is assigned to the assignee of the present application and is herein incorporated by reference.

In addition to the features discussed above, alternative preferred embodiments of the platform sections 12, 14 may have the following features.

- Although shown as having two platform sections 12, 14, alternative embodiments may have additional platform sections 12, 14.
- The exit points of the resistance mechanisms 20, 22 on the platform sections 12, 14 may be recessed (as shown in FIG. 3).
- The top surfaces of the platform sections 12, 14 may have a ⅛ inch to ½ inch deep recess in which a non-slip surface (e.g. pad) of neoprene, rubber, or other semi-soft material may be placed.
- The platform sections 12, 14 may be vacuum formed over the internal structure, injection molded over the internal structure, or constructed using any other relevant manufacturing process.
- The platform sections 12, 14 may have a smooth texture, a glossy texture, or may have a brushed appearance.
- The exercise platform 10 (and the case) may include an outer shell (cover) constructed from durable material(s) such as plastic (e.g. ABS plastic), fiberglass, metal, or synthetic material (e.g. KEVLAR®). These materials are meant to be exemplary and are not meant to limit the scope of the invention.
- The shown dimensions are meant to be exemplary and not to limit the scope of the invention. Further, the shown dimensions may be exaggerated or otherwise inexact for the purpose of enlarging small components or otherwise enhancing the understandability of this document.

Figure 6:
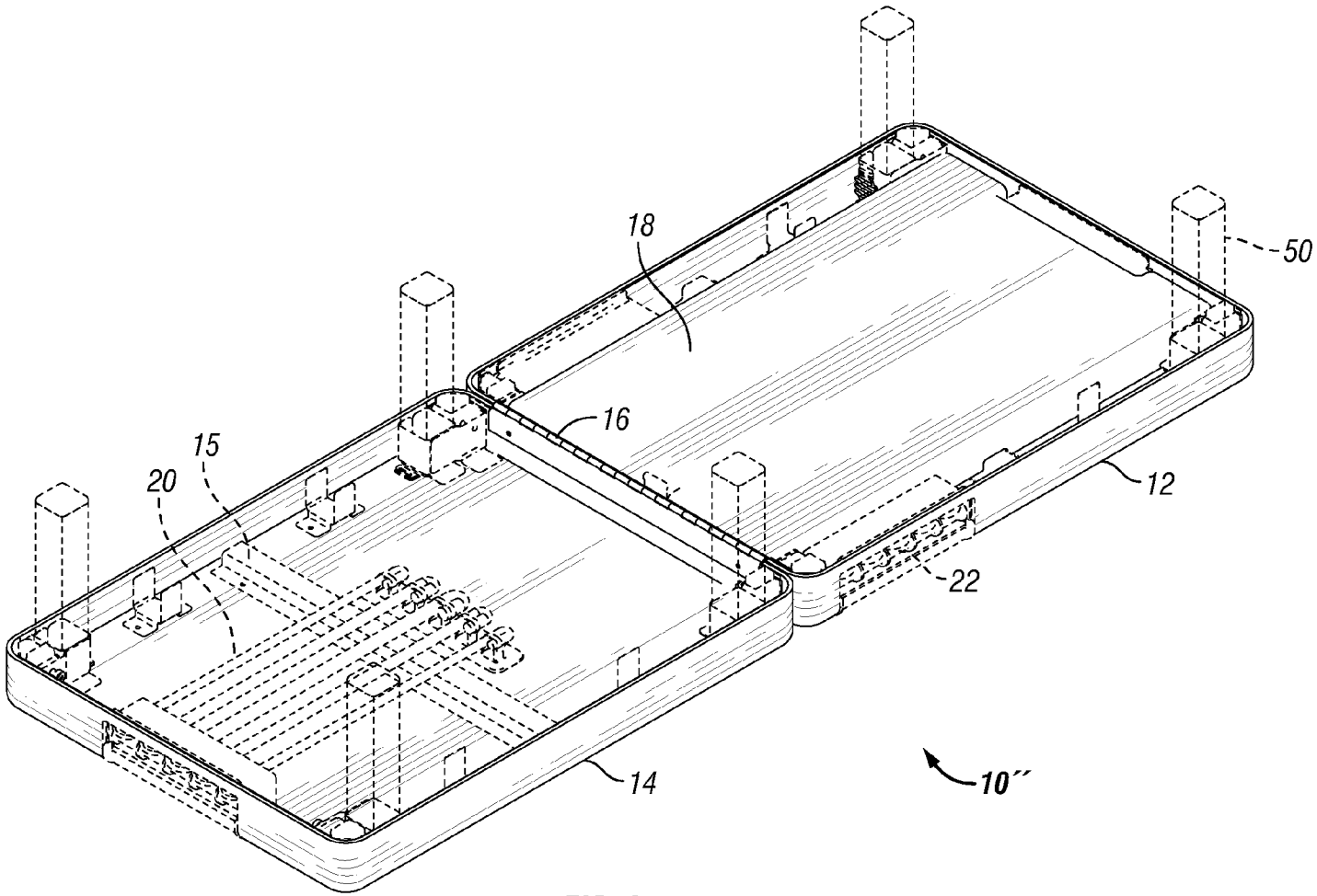
FIG. 6 is a bottom perspective view of a third exemplary preferred embodiment of an exercise platform of the present invention in the open condition with additional components of the invention shown in phantom.
Figure 7:
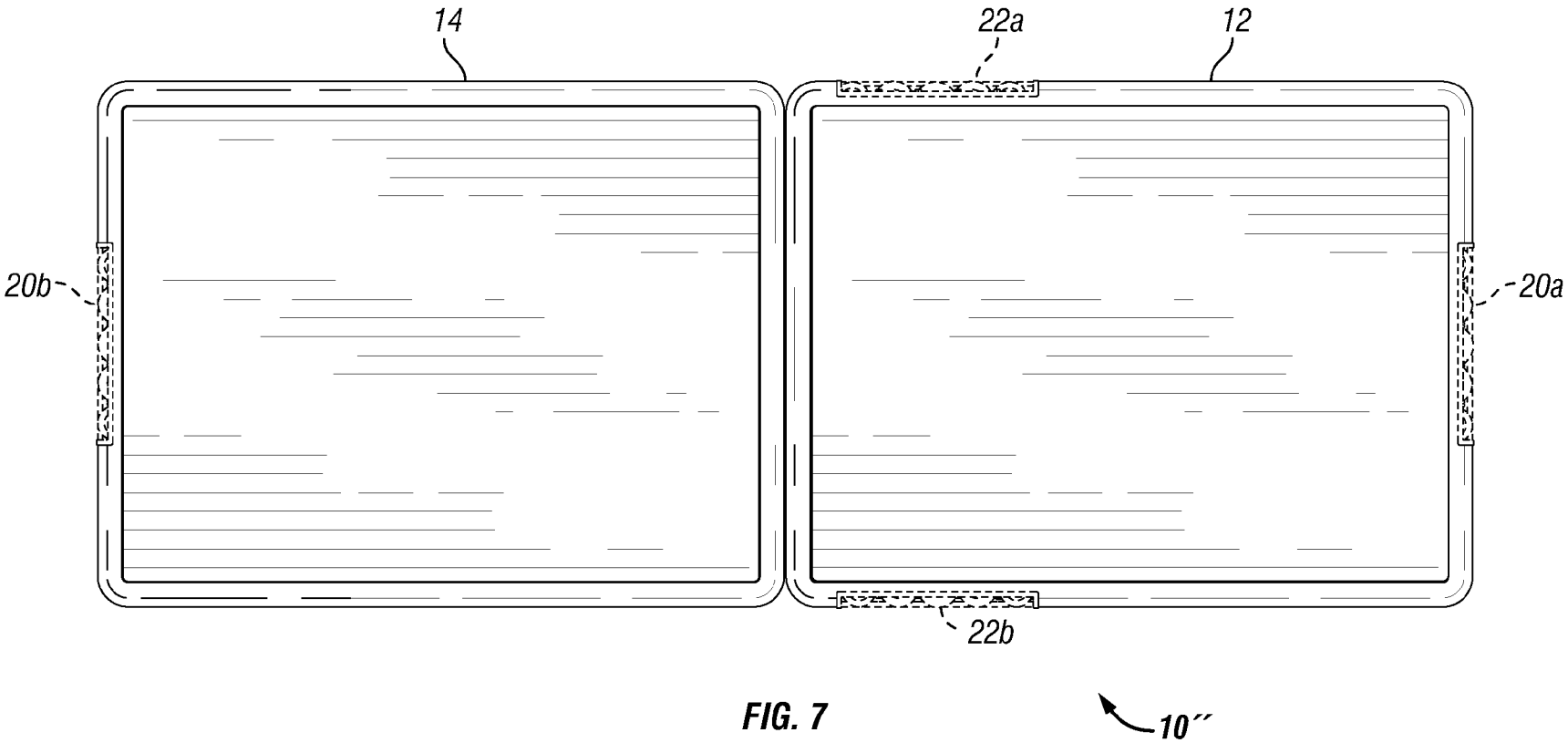
FIG. 7 is a top plan view of the third exemplary preferred embodiment of an exercise platform of the present invention in the open condition.
Figure 8:
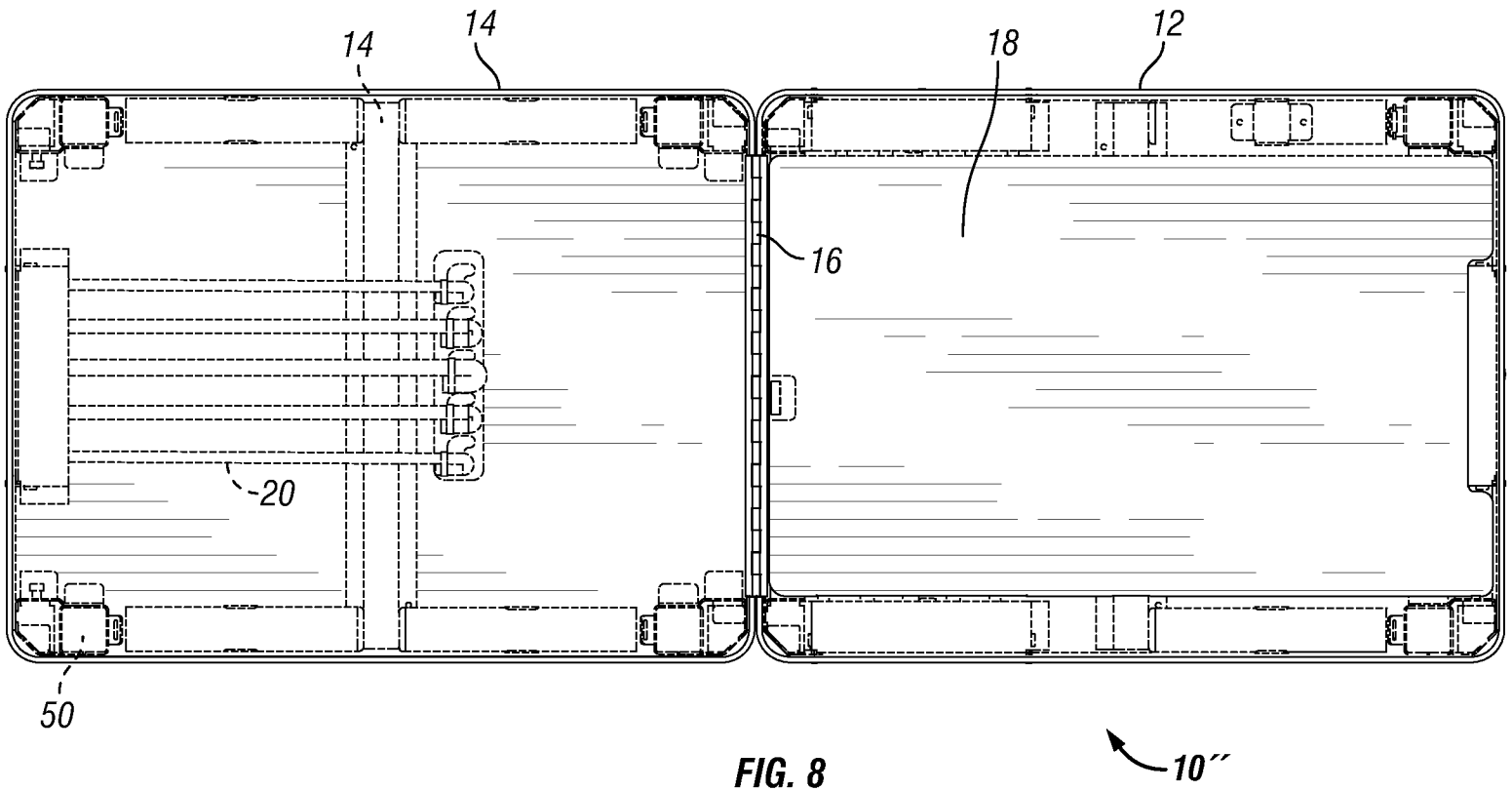
FIG. 8 is a bottom plan view of the third exemplary preferred embodiment of an exercise platform of the present invention in the open condition.
Figure 9:
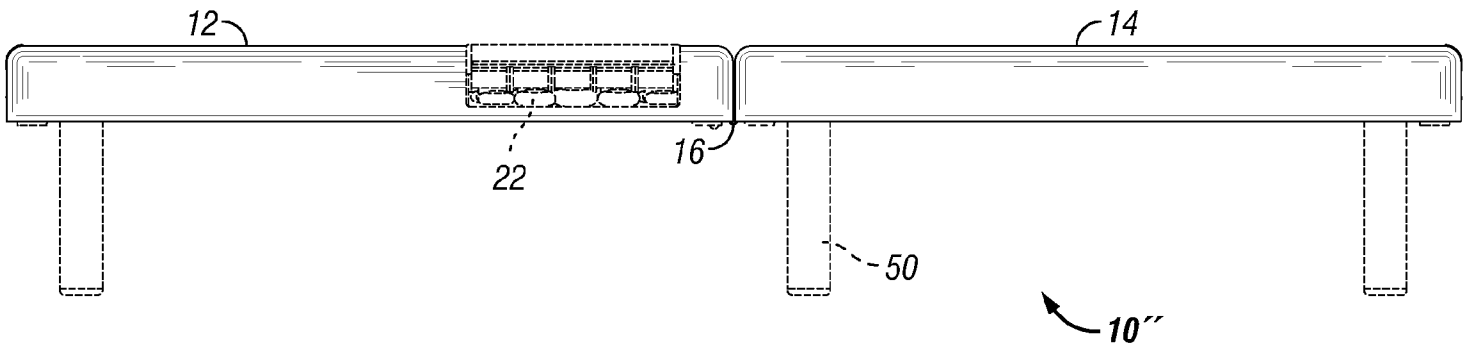
FIG. 9 is a front side view of the third exemplary preferred embodiment of an exercise platform of the present invention in the open condition, the legs (in phantom) being shown in an extended position.
Figure 10:
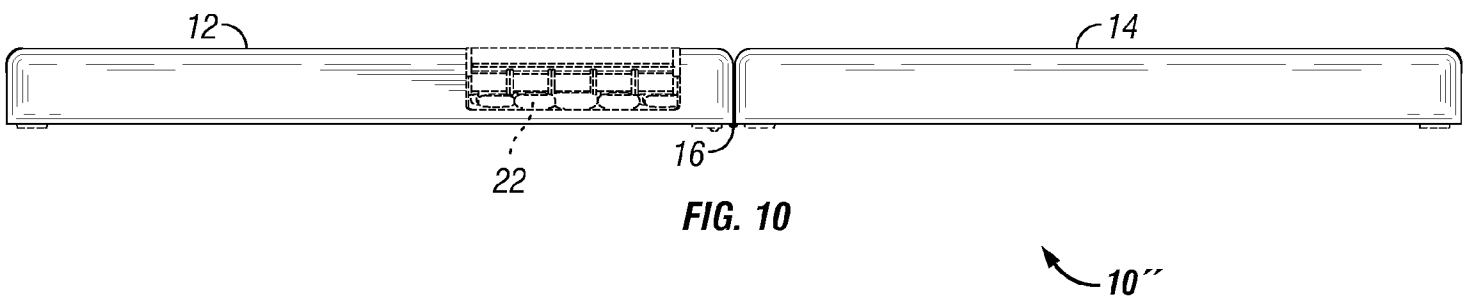
FIG. 10 is a front side view of the third exemplary preferred embodiment of an exercise platform of the present invention in the open condition, the legs being in a retracted position.
Figure 12:
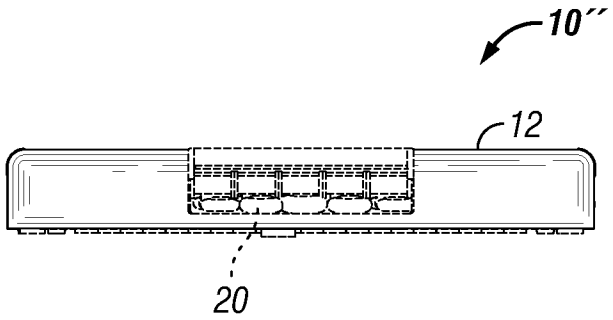
FIG. 12 is an end view of the third exemplary preferred embodiment of an exercise platform of the present invention in the open condition, the legs being in a retracted position.
Figure 11:
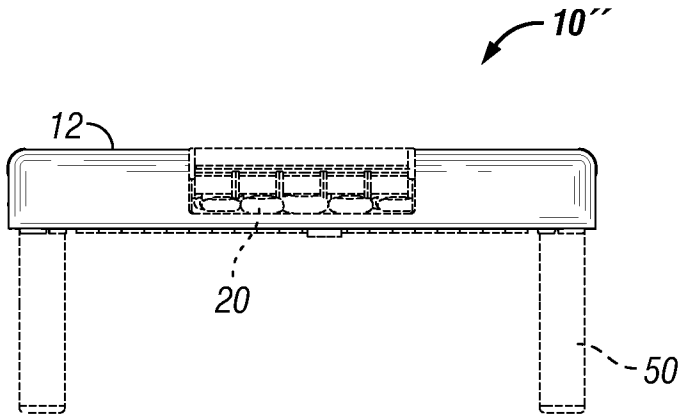
FIG. 11 is an end view of the third exemplary preferred embodiment of an exercise platform of the present invention in the open condition, the legs (in phantom) being shown in an extended position.
Figure 13:
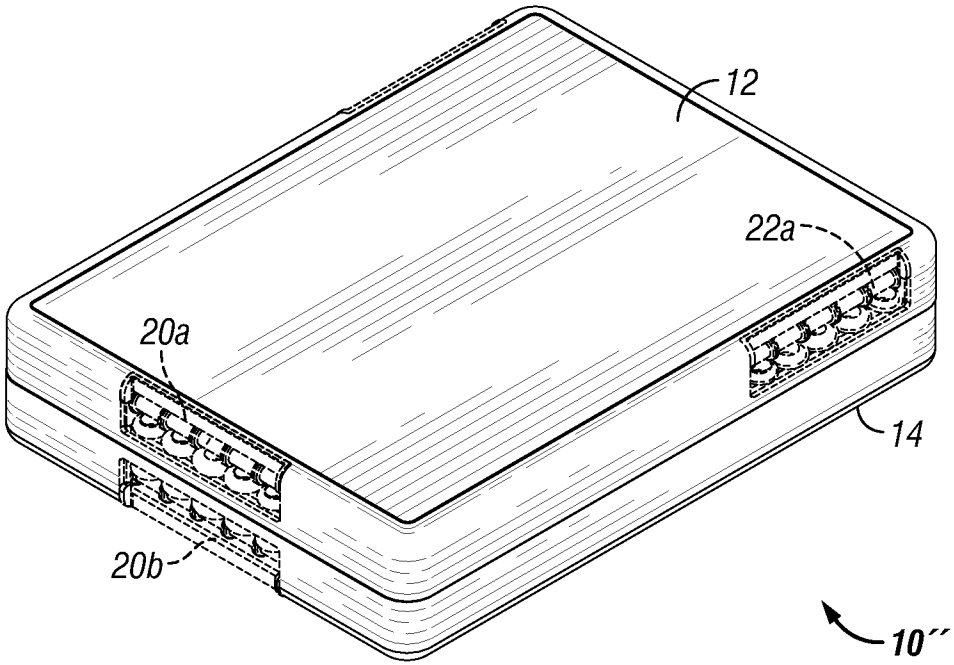
FIG. 13 is a perspective view of the third exemplary preferred embodiment of an exercise platform of the present invention in the closed condition.

In some embodiments such as the third preferred embodiment shown in FIGS. 5-12, the portable exercise platform 10" may include internal framework (internal structure) that is used to reinforce the platform/case (e.g. the support bar 15 shown in FIGS. 6 and 8). This embodiment and other embodiments having internal frameworks may have the following features.

- The internal framework is optional if the outer shell is strong enough to function without the internal framework. Alternatively, the outer shell and the internal framework may be a combined mechanism.
- The internal framework may be made of a sheet or ribbing constructed from magnesium, aluminum, steel, another metal, or any material suitably strong enough to provide support.
- The internal framework may carry snap features for legs 50, support a plastic outer shell, and/or hold roller pins.
- The internal framework may contain many peripheral parts made of the same material as the main internal framework and welded into place to give the overall structure more strength and stability.
- The shown dimensions are meant to be exemplary and not to limit the scope of the invention. Further, the shown dimensions may be exaggerated or otherwise inexact for the purpose of enlarging small components or otherwise enhancing the understandability of this document.

In some embodiments such as the fourth preferred embodiment shown in FIG. 26, the two exemplary platform sections 112, 114 of the portable exercise platform 110 may include an interior having defined (e.g. molded) grooves, indents, and other compartments defined therein. These defined compartments are preferably suitable for positioning or storing components such as longitudinal resistance mechanisms, latitudinal resistance mechanisms, handgrips, and/or exemplary spreaders.

The present invention may include one or more internal component and/or accessory covers 18. The cover(s) 18 may be used, for example, to protect the internal components (e.g. resistance bands 24, 26). The cover(s) 18 may be used, for example, to protect accessories (e.g. by forming an accessory bin for the spreaders 30 and/or handgrips 40). The cover(s) 18 may be used, for example, to hide the internal components and/or accessories (e.g. for aesthetic reasons). The cover(s) 18 may also be used as a place to attach a CD, DVD, or instruction booklet that can be used with the exercise platform 10. Exemplary preferred embodiments of the cover(s) 18 may have the following features.

- May be held in place by a hinge secured either to the case or the internal framework.
- May contain a locking mechanism at one end that enables the cover 18 to stay closed and locked in place.
- May contain a small strap at one end to facilitate opening the cover 18.
- The cover 18 may be constructed from durable material(s) such as plastic (e.g. ABS plastic), fiberglass, metal, or synthetic material (e.g. KEVLAR®). These materials are meant to be exemplary and are not meant to limit the scope of the invention.

The shown dimensions are meant to be exemplary and not to limit the scope of the invention. Further, the shown dimensions may be exaggerated or otherwise inexact for the purpose of enlarging small components or otherwise enhancing the understandability of this document.

As set forth above, in preferred embodiments of the exercise platform 10, the platform sections 12, 14 are preferably hingedly (e.g. using a hinge 16) connected so that they can transition between a closed condition and an open condition. It should be noted that alternative embodiments could use other connection mechanisms (other than a hinge), and that any connection mechanism that would facilitate both the closed condition and the open condition would be suitable for the present invention. It should be noted, however, that an exemplary preferred embodiment of the hinge 16 may have the following features.

Preferably a hinge 16 or a hinge-like device holds the two halves of the exercise platform 10 together. One advantage of using a hinge 16 is that the device can be opened and closed easily.

Although shown as a standard hinge 16, the hinge 16 may include structure that allows the platform sections 12, 14 to be held at any angle (either alone or with additional structure). This would allow platform sections 12, 14 to be held at a right and/or obtuse angle to support the user in a sitting or inclined position suitable for bench pressing.

In alternative embodiments the hinge 16 may be replaced with clips or another structure.

Preferably the hinge 16 is made from copper, brass, aluminum, magnesium, steel, another metal, or any other appropriate material. These materials are meant to be exemplary and are not meant to limit the scope of the invention.

The shown dimensions are meant to be exemplary and not to limit the scope of the invention. Further, the shown dimensions may be exaggerated or otherwise inexact for the purpose of enlarging small components or otherwise enhancing the understandability of this document.

Resistance Mechanisms, Spreaders, and Handgrips

In preferred embodiments of the present invention, a plurality (shown as two sets) of resistance mechanisms is used. The first set of resistance mechanisms is a two-part longitudinal (lengthwise) resistance mechanism 20*a*, 20*b* (referred to generally as the longitudinal resistance mechanism 20). In other words, the first set of resistance mechanisms can be thought of as a split longitudinal resistance mechanism. The term "split" refers to the fact that the two parts of the longitudinal resistance mechanism 20*a*, 20*b* are distanced from each other. The second set of resistance mechanisms is a latitudinal (crosswise) resistance mechanism 22 (that includes two "parts" or "sides" 22*a*, 22*b* that are interwoven). The terms "interwoven" and "alternating" are used to describe a space-saving feature. If the platform 10 were wide enough, an alternate preferred embodiment the "parts" or "sides" 22*a*, 22*b* would not be interwoven. It should be noted that if longer longitudinal resistance mechanisms 20*a*, 20*b* were desired, they could be interwoven/alternating.

As shown in FIG. 1, in exemplary preferred embodiments there are five (5) resistance bands 24 in the first half of the split longitudinal resistance mechanism and five (5) resistance bands 24 in the second half of the split longitudinal resistance mechanism, five (5) resistance bands 26 in the first side of the latitudinal resistance mechanism, and five (5) resistance bands 26 in the second side of the latitudinal resistance mechanism. In the shown embodiments, all of the resistance bands 24, 26 have the same size, shape, and resistance so that they are interchangeable, but specialized resistance bands could be used. It should be noted that alternative preferred embodiments may have a different configuration such as (1) inclusion of a second latitudinal (crosswise) resistance mechanism in the second platform section 14 (the second latitudinal resistance mechanism may also include two "sides"), (2) inclusion of only the longitudinal resistance mechanism, (3) inclusion of only the latitudinal resistance mechanism, or (4) inclusion of a unitary longitudinal and/or latitudinal resistance mechanism (as opposed to the two-part preferred embodiments).

One of the advantages of the present invention is its adaptability to accommodate users of different strengths or to accommodate a single user who needs different resistances for different exercises. One way that this is accomplished is by allowing the user to selectively use more or fewer resistance bands 24, 26 for each resistance mechanism 20, 22. As shown in FIG. 3, each resistance band 24, 26 has a first ("free" or "working") end and a second ("anchoring") end. The first end is associated with a first part of a connection component (shown as thimble 28). The second end is preferably attached to the exercise platform 10 using an anchoring or securing apparatus 29 (FIG. 1). It should be noted that the second end may be attached to the exercise platform 10 using releasable clamps or any other type of securing apparatus 29. In preferred embodiments, the securing apparatus 29 would allow the resistance bands 24, 26 to be removed and replaced. Each thimble 28 can be removably attached to a spreader 30 or removably seated on the platform 10. When the thimble 28 is attached to the spreader 30, it is specifically attached to a second part of the connection component (shown as an aperture or hole 32 defined in the spreader 30). In FIG. 3, three thimbles 28 (each associated with a resistance band 24) are attached to respective apertures or holes 32 defined in the spreader 30. When the thimble 28 is attached to the platform 10, it is specifically attached to a second part of the connection component (shown as a notch or seat 34) associated with the platform 10. In FIG. 3, since only three resistance bands 24 are used, the remaining unused thimbles 28 remain in respective notches or seats 34 associated with the platform 10. In use, a user could choose to use fewer (e.g. one or two) resistance bands 24, 26 for less resistance and more (e.g. four or five) resistance bands 24, 26 for greater resistance. The user would attach the desired number of resistance bands 24, 26 to each spreader 30.

An exemplary preferred embodiment of the resistance mechanism may have the following features.

Resistance bands 24, 26 may be, for example, high grade surgical tubing, bungee cords, resistance cords, or any other appropriate material with calculable resistance.

The range in resistance per resistance band 24, 26 is preferably from 2 lbs to 50 lbs. Ranges may be indicated by weight and/or by descriptions such as extra light, light, light-medium, medium, medium-heavy, heavy, and extra heavy.

Each exercise platform 10 preferably contains a plurality (shown as twenty (20)) of separate resistance bands 24, 26 for use in the resistance mechanisms. In the shown embodiments, there are five (5) resistance bands 24 in the first half of the split longitudinal resistance mechanism, five (5) resistance bands 24 in the second half of the split longitudinal resistance mechanism, five (5) resistance bands 26 in the first side of the latitudinal resistance mechanism, and five (5) resistance bands 26 in the second side of the latitudinal resistance mechanism. More or fewer resistance bands 24 could be used in alternative embodiments.

Each resistance band is shown as being between 8 and 20 inches long, but this length should not be seen as limiting the scope of the invention, as bands having alternative lengths could be used for a particular purpose. These materials are meant to be exemplary and are not meant to limit the scope of the invention.

The second anchoring end of each band may be a thimble or reinforced loop that is preferably attached to the exercise platform 10 using an appropriate metal clip.

In alternative embodiments, the working end of each band may be attachable to a hook, clip, loop, or carabineer that is part of, replaces, or is associated with the spreader 30 or the end of the extendable-retractable strap 42.

The shown dimensions are meant to be exemplary and not to limit the scope of the invention. Further, the shown dimensions may be exaggerated or otherwise inexact for the purpose of enlarging small components or otherwise enhancing the understandability of this document.

The shown spreader 30 is a sturdy attachment device designed to serve as an intermediary between the resistance mechanisms 20, 22 and the extendable-retractable strap 42 of the handgrips 40. In the shown embodiment, a first end (shown as the relative "bottom") has a plurality of connection components (shown as an aperture or hole 32 defined in the spreader 30) that are designed to connect with the connection component (shown as thimble 28) of each of the resistance bands 24, 26. In the shown embodiment, a second end (shown as the relative "top") has a connection component (shown as an aperture or hole 36 defined in the spreader 30) that is designed to connect with the connection component (shown as hook 38) at the end of the extendable-retractable strap 42. In the shown embodiment, the spreader 30 also provides a spreading function by keeping the resistance bands 24, 26 properly aligned and/or spaced. It should be noted that alternative embodiments could use a simpler connector (e.g. a sturdy loop or a carabineer), or the extendable-retractable strap 42 could be attached directly to the resistance bands 24, 26. An exemplary preferred embodiment of the spreader may have the following features.

The spreader 30 may be integral with or permanently attached to the end of the extendable-retractable strap 42 and/or the hook 38.

The connection components are meant to be exemplary. For example, the hole or aperture connection components could be pegs, hooks, or clamps and the associated connection components could be adapted to be connectable thereto.

The shown shape of the spreader 30 is meant to be exemplary.

The spreader 30 may be made of materials such as metal, heavy plastic, or other sturdy materials. These materials are meant to be exemplary and are not meant to limit the scope of the invention.

The shown dimensions are meant to be exemplary and not to limit the scope of the invention. Further, the shown dimensions may be exaggerated or otherwise inexact for the purpose of enlarging small components or otherwise enhancing the understandability of this document.

The spreader 30 is, in turn, connected to a unique handgrip 40 (shown in detail in FIGS. 4 and 23-25) via an extendable-retractable strap 42. The unique handgrips 40 are used in conjunction with the exercise platform 10 allow the user to maneuver between exercises without having to manipulate the length of the resistance mechanisms 20, 22. An extension and retraction mechanism 44 within each handgrip 40 controls the extension and retraction of the extendable-retractable strap 42. This extension and retraction feature makes it possible for the user to start any exercise with no tension on the resistance mechanism(s) 20, 22, thereby allowing the maximum range of use. The extension and retraction mechanism 44 of the handgrips 40 may function in a manner similar to the manner in which retractable animal leashes function. When the extension and retraction mechanism 44 is "engaged" (e.g. providing friction against the extendable-retractable strap 42), the extendable-retractable strap 42 is maintained at its current position (i.e. the strap 42 does not extend or retract). When the extension and retraction mechanism 44 is "disengaged" (e.g. there is no friction against the extendable-retractable strap 42), the extendable-retractable strap 42 is able to wind and/or unwind from a spool 46 within extension and retraction mechanism 44 (i.e. the strap 42 can extend or retract). In use, the user grips a gripping portion 48 of the handgrip 40. The handgrips 40 are preferably designed to be ergonomically correct to the average-sized hand of both males and females, which reduces strain in the fingers, hand and forearm. It should be noted that a second set of handgrips could be designed to connect with a user's feet, or the handgrips may be designed to connect either with the user's hands or feet.

The following cited references could function as or be modified to function as retractable handgrips 40, and the expanding/retracting feature would function on the same basic principle: U.S. Pat. No. 7,168,393 to Bogdahn, et al., U.S. Pat. No. 7,040,257 to Waxman, et al., U.S. Pat. No. 6,845,736 to Anderson, U.S. Pat. No. 5,890,456 to Tancrede, U.S. Pat. No. 4,269,150 to McCarthy, and U.S. Pat. No. 4,018,189 to Umphries. These references are herein incorporated by reference.

FIG. 3 also shows an optional preferred embodiment of the roller pins 52 positioned in the recessed portion of the exercise platform 10 where the resistance mechanisms 20, 22 exit the exercise platform 10. The roller pins 52 are primarily provided so that the resistance bands 24, 26 have a smooth surface over which to glide as they stretch. In other words, the roller pins 52 allow the resistance bands 24, 26 to be engaged and/or stretched without distinguishable friction against the outer shell or case. The roller pins 52 may also act as a mechanism for keeping the resistance bands 24, 26 in their provided spaces, preventing the resistance bands 24, 26 from crossing over each other. In preferred embodiments the roller pins 52 may have the following features.

The roller pins 52 are preferably securely attached to the shell and/or internal framework through a spot weld, or another appropriate method. In an alternative embodiment the roller pins 52 are preferably rotatably attached to the shell and/or internal framework.

The roller pins 52 may have grooves, guides, or channels to help properly position the resistance bands 24, 26.

The roller pins 52 are preferably made from copper, brass, aluminum, magnesium, steel, another metal or plastic, or any other appropriate material. These materials are meant to be exemplary and are not meant to limit the scope of the invention.

The shown dimensions are meant to be exemplary and not to limit the scope of the invention. Further, the shown dimensions may be exaggerated or otherwise inexact for the purpose of enlarging small components or otherwise enhancing the understandability of this document.

Additional Features and Components

As shown, preferred embodiments of the exercise platform 10 include a plurality of legs 50. The exercise platforms 10 can be used with the legs 50 deployed or un-deployed. The purpose of the legs 50 is to provide a cardiovascular workout in the form of a "stair stepper," and to provide comfort when performing some of the basic exercises such as the bench press. The goals of the user for a particular workout will generally dictate whether the legs 50 will be used. Both the first embodiment of the exercise platform 10 and the second embodiment of the exercise platform 10' have eight legs 50. The third embodiment of the exercise platform 10" is shown as having only six legs 50. Exemplary preferred embodiments of the legs 50 may have the following features.

- The legs 50 may be folded using a press break or other appropriate mechanism.
- The legs 50 may be held in place when not deployed by a metal snap attached to the internal structure.
- The legs 50 may be capped at the end with a non-slip cap.
- The legs 50 may be constructed using magnesium, aluminum, steel, other metal, or any material suitably strong enough to provide support to the exercise platform 10 as well as the anticipated weight of the user. These materials are meant to be exemplary and are not meant to limit the scope of the invention.
- The shown dimensions are meant to be exemplary and not to limit the scope of the invention. Further, the shown dimensions may be exaggerated or otherwise inexact for the purpose of enlarging small components or otherwise enhancing the understandability of this document.

Alternative preferred embodiments of the present invention may include an optional removable handgrip connection shaft 54. Such an optional removable handgrip connection shaft 54 is shown in FIG. 5 and is one of the features that distinguish this second embodiment of the exercise platform 10' from the first embodiment of the exercise platform 10. As shown, the optional removable handgrip connection shaft 54 has two ends, each end being connected to the gripping portion 48 of a handgrip 40. The purpose of the optional removable handgrip connection shaft 54 is to span the distance between the two handgrips 40 so that the user can use it as the "bar" in a barbell. The shown optional removable handgrip connection shaft 54 has two sections, but alternative embodiments may be a single unit or may have more than two sections. In preferred embodiments the removable handgrip connection shaft 54 can be stored in the closed platform (case) 10. The optional removable handgrip connection shaft 54 may be added to any of the embodiments of the exercise platform 10.

Alternative preferred embodiments of the present invention may include limiter cables 56, each limiter cable 56 having one end attached to and/or near the spreader 30 and one end attached to and/or near the platform 10. Such a limiter cable 56 is shown in FIG. 5 and is one of the features that distinguish this second embodiment of the exercise platform 10' from the first embodiment of the exercise platform 10. The purpose of the limiter cable 56 is to limit how far the resistance mechanisms 20, 22 can stretch. Use of the limiter cable 56 may preserve the life of the resistance mechanisms 20, 22, and/or act as a safety mechanism. It should be noted that the limiter cable 56 may be made from any material that has less "stretch" than the resistance mechanisms 20, 22. It should be noted that the ends of the limiter cables 56 may be attached at different locations. The limiter cable 56 may be added to any of the embodiments of the exercise platform 10.

Alternative preferred embodiments of the present invention may include one or more carrying handles 58. An exemplary carrying handle 58 is shown in FIG. 5 and is one of the features that distinguish this second embodiment of the exercise platform 10' from the first embodiment of the exercise platform 10. The purpose of the carrying handle 58 is to provide an easy mechanism by which a user may lift the exercise platform 10. Although shown as being positioned on a side of the exercise platform 10, the carrying handle 58 may alternatively be positioned on one or both ends of the exercise platform 10. The carrying handle 58 may be added to any of the embodiments of the exercise platform 10.

Alternative preferred embodiments of the present invention may include at least one latch, lock or other closure mechanism (not shown) that helps keep the platform sections 12, 14 in the closed condition when the invention is being carried. In some preferred embodiments, this closure mechanism would be a two-part closure mechanism, having one part located on each of the platform sections 12, 14 at the end opposite the hinge 16. When the exercise platform 10 is in the closed condition, the two parts of the closure mechanism(s) would interact to secure the exercise platform 10 in the closed condition.

Preferred embodiments of the exercise platform 10 may include a non-slip (workout) pad 60. In preferred embodiments, the platform sections 12, 14 may each be recessed so that the non-slip pad 60 may be inlaid therein. The non-slip pad 60 may have the following features.

- The non-slip pad 60 may be replaceable so that it may be cleaned and/or replaced.
- The non-slip pad 60 is preferably cut to appropriate dimensions to fit into the recessed space provided by the platform sections 12, 14.
- The non-slip (workout) pad 60 may be made of neoprene, rubber, or other semi-soft, non-slip material. These materials are meant to be exemplary and are not meant to limit the scope of the invention.
- The shown dimensions are meant to be exemplary and not to limit the scope of the invention. Further, the shown dimensions may be exaggerated or otherwise inexact for the purpose of enlarging small components or otherwise enhancing the understandability of this document.

Methods of Use

Figure 19:
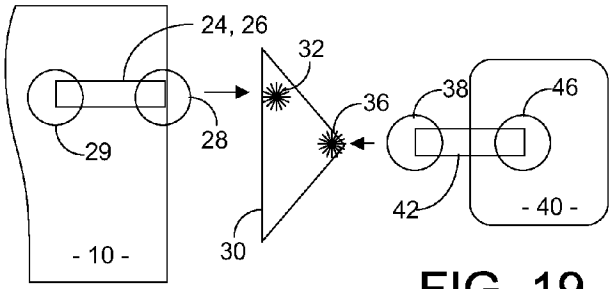
FIG. 19 is a simplified block diagram showing an exercise platform, a single resistance band, a spreader attachment device, an extendable-retractable strap, and a handgrip prior to any connections being made.

From the closed condition, the user will open the exercise platform 10 to gain access to the optional accessory cover(s) 18 and/or accessories (e.g. spreaders 30 and handgrips 40) within the exercise platform 10 (case). Depending on the intended use of the exercise platform 10, the legs 50 may be deployed (e.g. brought into a position perpendicular to the main body of the platform sections 12, 14) or left un-deployed (e.g. folded within the platform sections 12, 14). The exercise platform 10 may then be put in the open (working) condition and turned upright. At this point the system is in the condition shown in FIG. 19 with an exercise platform 10 (including platform sections 12, 14), resistance bands 24, 26 (shown as a single resistance band), spreader 30, extendable-retractable strap 42, and a handgrip 40 prior to any connections being made.

The user can now select the desired amount of resistance by attaching a selective number of each resistance band 24, 26 (using the thimble 28 connection component) to the spreader 30 (using one of the plurality of aperture or hole 32 connection components defined in the spreader 30). The amount of resistance is determined by the number of resistance bands 24, 26 (i.e. more resistance bands 24, 26 create more resistance). In the shown embodiment, each of the resistance bands 24, 26 have the same resistance. If each part of a resistance mechanism 20, 22 has five (5) resistance bands 24, 26, and each resistance band 24, 26 has 10 pounds of resistance, the user could select between 10 pounds, 20 pounds, 30 pounds, 40 pounds, or 50 pounds on each of the two parts of the resistance mechanisms 20, 22. In an alternative embodiment, all of the resistance bands 24, 26 could have different resistances. For example, each part of a resistance mechanism 20, 22 having five (5) resistance bands 24, 26 could have a 3-pound resistance band 24, 26, a 5-pound resistance band 24, 26, a 10-pound resistance band 24, 26, a 20-pound resistance band 24, 26, and a 40-pound resistance band 24, 26. The user could then select between 3 pounds, 5 pounds, 8 pounds, 10 pounds, 13 pounds, 15 pounds, 18 pounds, 20 pounds, 23 pounds, 25 pounds, 28 pounds, 30 pounds, 33 pounds, 35 pounds, 38 pounds, 40 pounds, 43 pounds, 45 pounds 48 pounds, 50 pounds, 53 pounds, 55 pounds, 58 pounds, 60 pounds, 63 pounds, 65 pounds, 68 pounds, 70 pounds, 73 pounds, 75 pounds, or 78 pounds, on each of the two parts of the resistance mechanisms 20, 22.

The user then attaches the extendable-retractable strap 42 of the handgrip 40 to the spreader 30 by attaching the hook 38 connection component of the extendable-retractable strap 42 to the aperture or hole 36 defined in the "top" of the spreader 30. It should be noted that this step could be performed before the attachment of the step of attaching the resistance bands 24, 26 to the spreader 30.

Figure 20:
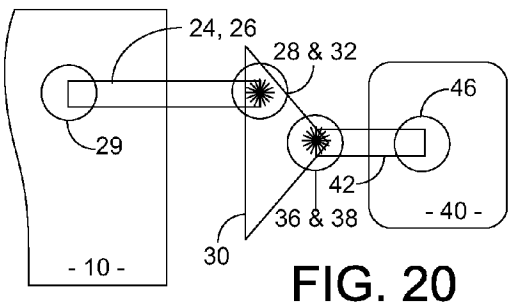
FIG. 20 is a simplified block diagram showing the exercise platform connected to the spreader attachment device via the single resistance band, and the spreader attachment device connected to the handgrip via the extendable-retractable strap.

FIG. 20 shows the exercise platform 10 connected to the spreader 30 via a resistance band 24, 26, and the spreader 30 attachment device connected to the handgrip via the extendable-retractable strap.

Figure 14:
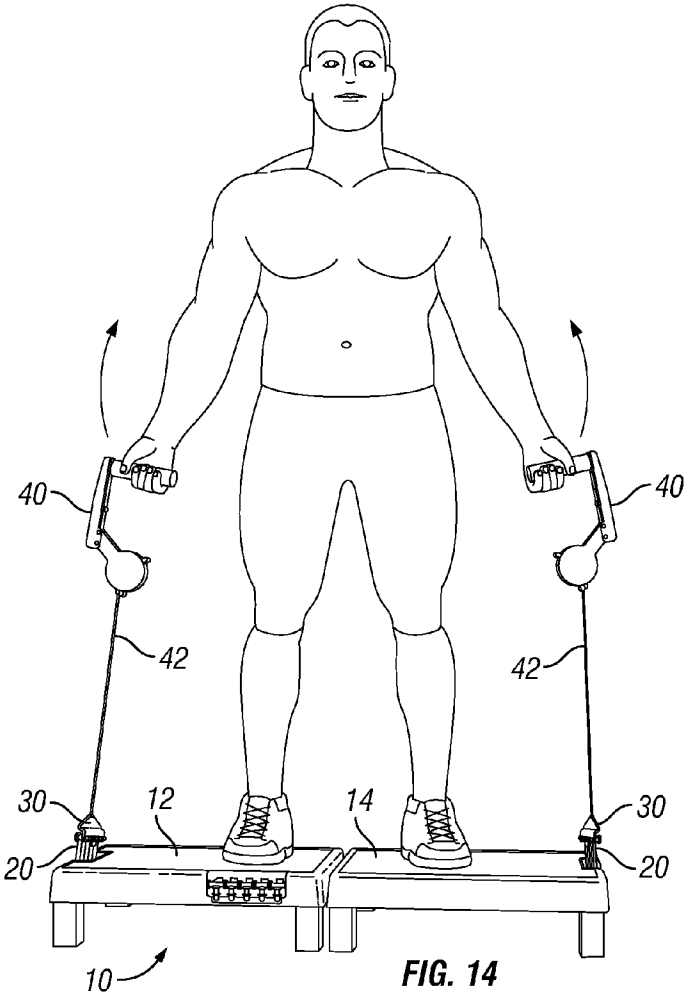
Figure 18:
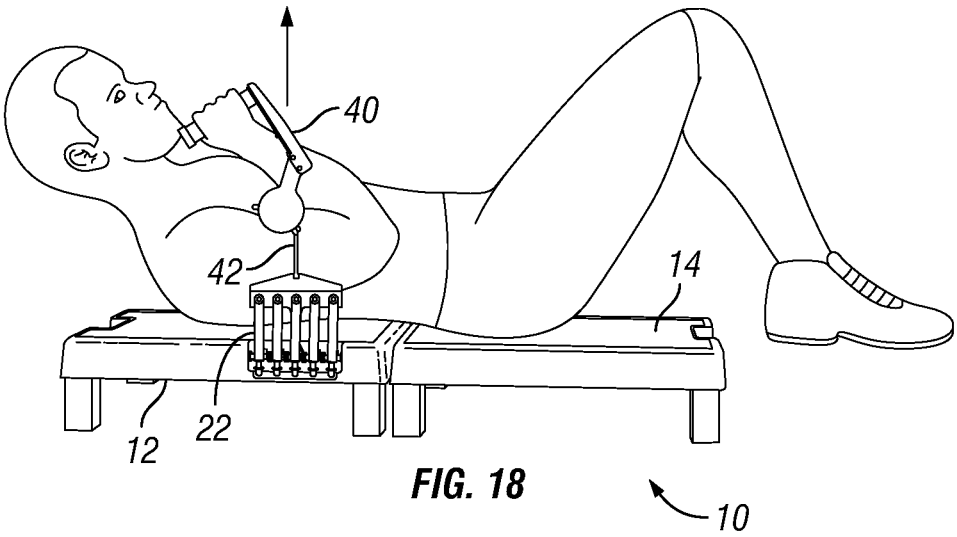
Figure 21:
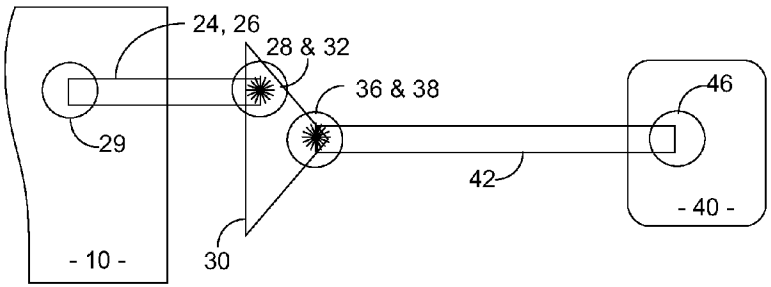
FIG. 21 is a simplified block diagram showing the extendable-retractable strap between the spreader attachment device and the handgrip in an extended condition.

Once each handgrip 40 has been connected to the spreader 30, which in turn has been attached to the desired number of resistance bands 24, 26, the user can disengage the extension and retraction mechanism 44, position himself for the desired exercise, and engage the extension and retraction mechanism 44 with the extendable-retractable strap 42 at the desired length (the extended condition). FIG. 21 shows the extendable-retractable strap 42 between the spreader 30 and the handgrip in an extended condition. FIG. 14 and FIG. 18 show graphical representations of the user positioned for the desired exercise and the extendable-retractable strap 42 set at the proper length. It should be noted that the resistance bands 24, 26 at this time are substantially relaxed (do not have tension thereon).

Figure 15:
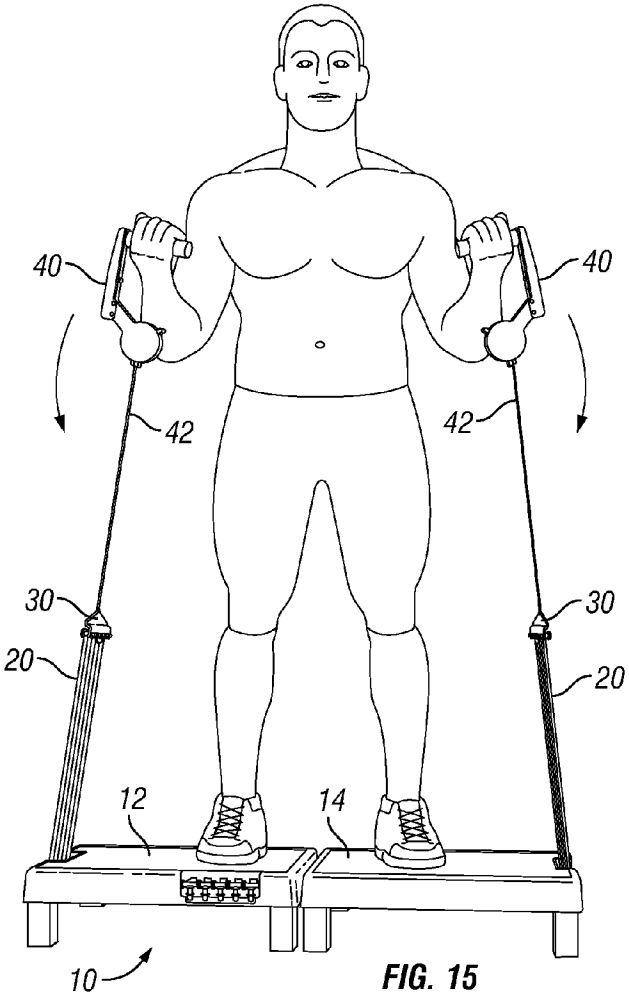
FIGS. 14 and 15 show a user standing on an exercise platform with the handgrips attached to the longitudinal resistance mechanisms to perform a bicep curl, FIG. 14 showing the user's arms extended so that the resistance mechanisms are relaxed (do not have tension thereon) and FIG. 15 showing the user's arms curled so that the resistance mechanisms are stretched (have tension thereon).
Figure 16:
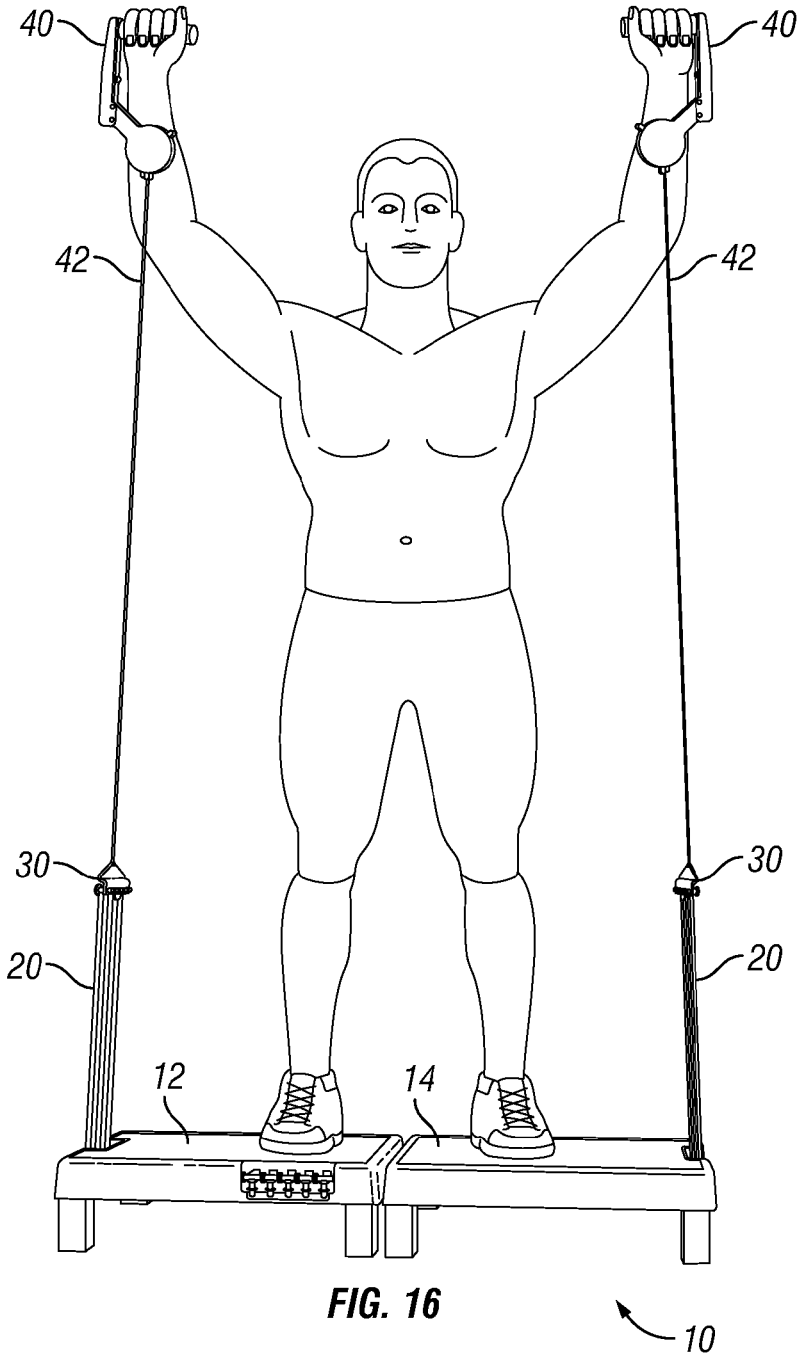
FIG. 16 shows a user using an exercise platform with his arms raised above his head and the resistance mechanisms stretched (have tension thereon).
Figure 17:
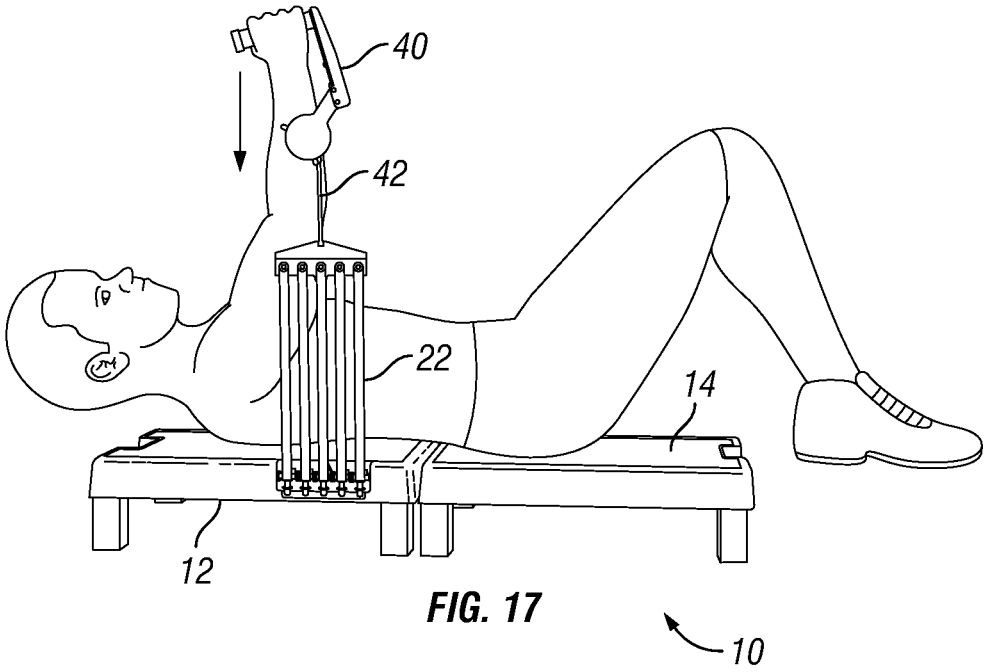
FIGS. 17 and 18 show a user lying on an exercise platform with the handgrips attached to the latitudinal resistance mechanisms to perform a pressing exercise, FIG. 17 showing the user's arms extended so that the resistance mechanisms are stretched (have tension thereon) and FIG. 18 showing the user's arms curled so that the resistance mechanisms are relaxed (do not have tension thereon).
Figure 22:
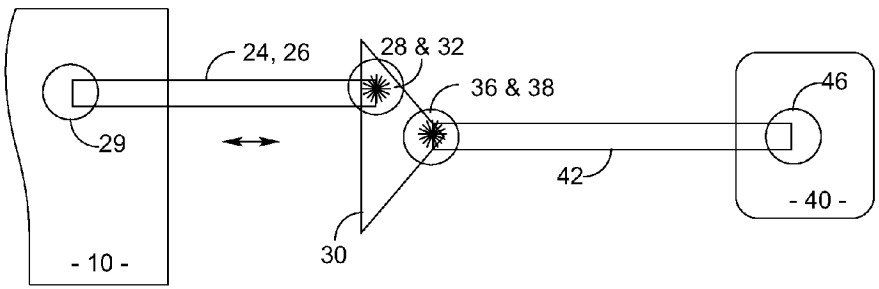
FIG. 22 is a simplified block diagram showing the single resistance band between the exercise platform and the spreader attachment device in a stretched condition.
Figure 24:
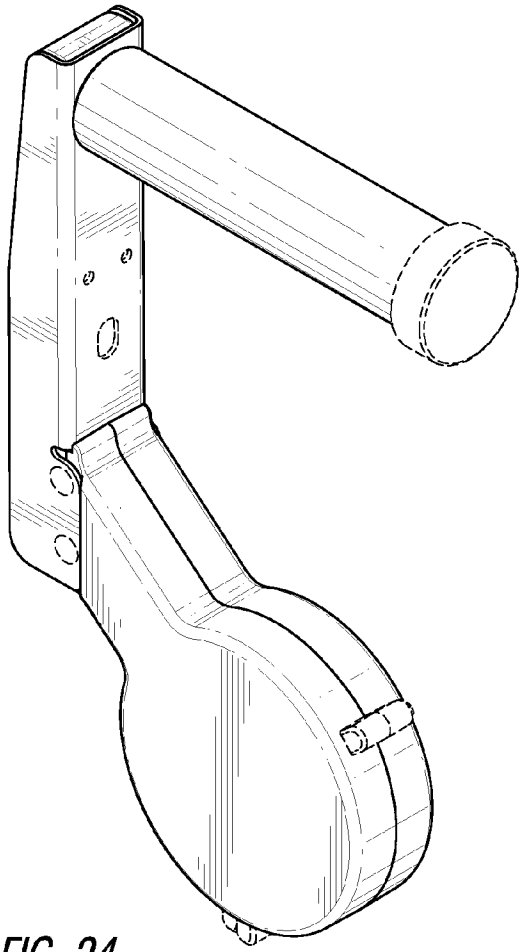
FIG. 24 is an angled isometric view of the exemplary handgrip, the angle of this figure being approximately at a right angle to the angled isometric view of FIG. 23.
Figure 23:
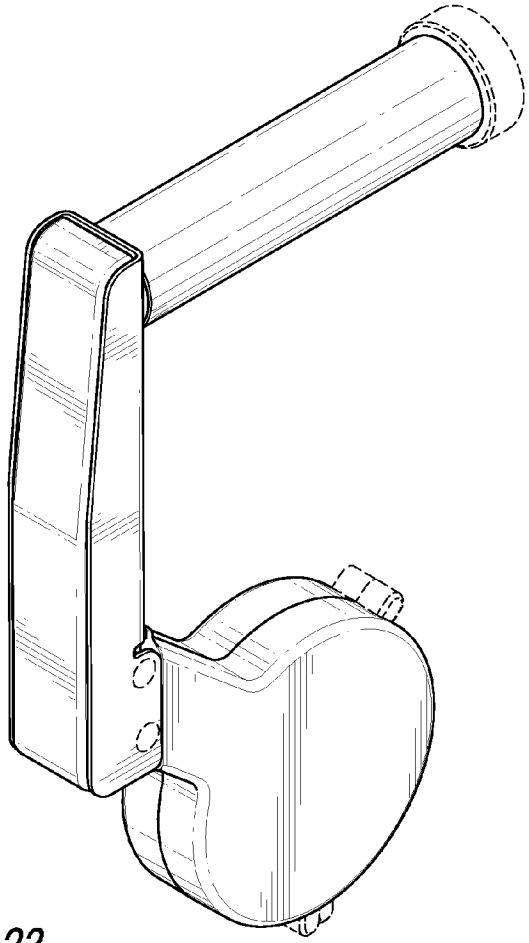
FIG. 23 is an angled isometric view of an exemplary handgrip of the present invention.
Figure 25:
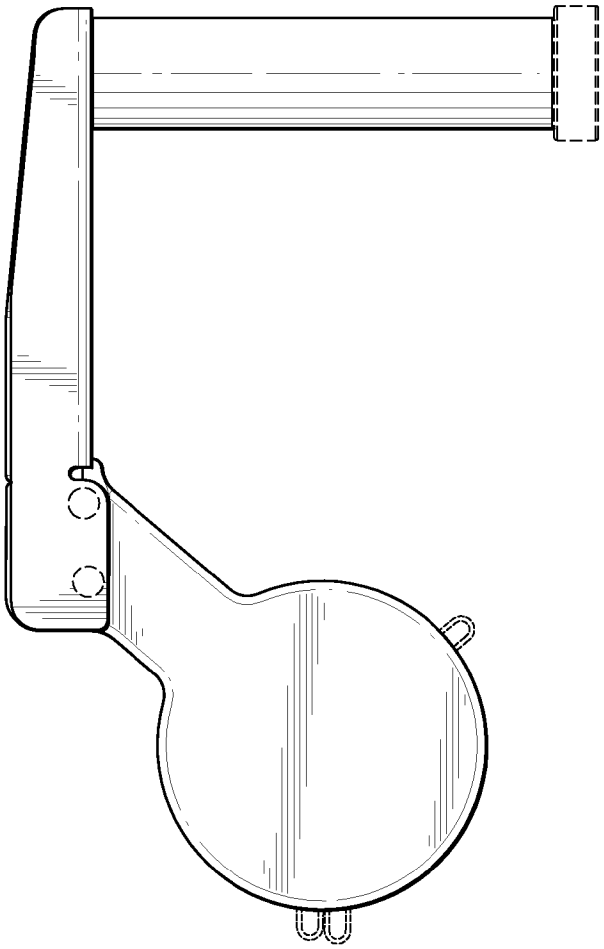
FIG. 25 is a front view of the exemplary handgrip.

The user is now ready to begin the exercise. At the beginning of an exercise, the resistance bands 24, 26 are substantially relaxed (do not have tension thereon). The stretching of the resistance bands 24, 26 provides tension/resistance. FIG. 22 shows the resistance band 24, 26 between the exercise platform 10 and the spreader 30 in a stretched condition. FIGS. 15, 16, and 17 are graphical representations of the user at the "end" of an exercise motion with the resistance bands 24, 26 substantially stretched (having tension thereon).

The user can change or replace resistance bands 24, 26 without any special tools or complicated means. The anchoring or securing apparatus 29 is opened or released so that the anchoring end of the resistance band 24, 26 is released. The thimble 28 connection component at the working end of the resistance band 24, 26 is also disengaged (most likely from the notch or seat 34 connection component in the platform). A new resistance band 24, 26 is chosen and its anchoring end is secured with the securing apparatus 29 and the thimble 28 is preferably placed in the seat 34.

FIGS. 14-18 show a user demonstrating exercising using the present invention. FIGS. 14 and 15 show the user engaged in a standard "bicep curl" while in the standing position. Significantly, once set at the beginning of an exercise, the length of the extendable-retractable strap 42 does not change. Only the length of the resistance mechanisms 20 changes as they stretch (shown in FIG. 15) and relax (shown in FIG. 14). FIG. 16 shows the user at the end of an exercise with the resistance mechanisms 20 stretched. FIGS. 17 and 18 show the user engaged in an exercise lying on the exercise platform 10. Significantly, once set at the beginning of an exercise, the length of the extendable-retractable strap 42 does not change. Only the length of the resistance mechanism 22 changes as it stretches (shown in FIG. 17) and relaxes (shown in FIG. 18). Legs could be exercised, for example, by starting in a position similar to that shown in FIG. 14, except with the extendable-retractable strap 42 much shorter and the user's knees bent. The user would then stand up, stretching the resistance mechanisms 20.

The user can use the present invention to perform exercises including those listed:

Core
- Abdominal crunches
- Back extensions
- Side or oblique bends

Chest
- Chest press (straight)
- Chest press (lower)
- Chest press (upper)
- Chest press
- Incline push-up
- Decline push-up Shoulders
- Shoulder press
- Shoulder raises (front)
- Shoulder raises (lateral)
- Shoulder raises (back)
- Shoulder shrugs
- Upright rows Arms
- Bicep curls (straight)
- Bicep curls (interior)
- Bicep curls (exterior)
- Hammer curls
- Standing triceps extensions
- Reverse triceps extensions
- Forearm curls
- Forearm extensions Back
- Back flys
- Bent over rows
- Seated rows
- Upright rows
- Back extensions Legs
- Squat
- Lunges
- Leg raises (lateral)
- Leg raises (front)
- Leg curls
- Calf raises When the user has completed his/her exercise routine, the handgrips 40 can be placed back into the accessory bin or component accessory cover 18 within the platform sections 20, 22, and the platform sections can then be folded together and stored.

It should be noted that the terms and phrases may have additional definitions and/or examples throughout the specification. Where otherwise not specifically defined, words, phrases, and acronyms are given their ordinary meaning in the art. Exemplary embodiments may be better understood with reference to the drawings, but these embodiments are not intended to be of a limiting nature.

It should be noted that some terms used in this specification are meant to be relative. For example, the terms "longitudinal" and "latitudinal" are meant to be relative. Similarly, the term "front" is meant to be relative to the term "back" and the term "top" is meant to be relative to the term "bottom."

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities).

All the references cited herein are incorporated by reference.

The terms and expressions that have been employed in the foregoing specification are used as terms of description and not of limitation, and are not intended to exclude equivalents of the features shown and described. This application is intended to cover any adaptations or variations of the present invention. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention which, as a matter of language, might be said to fall therebetween.

What is claimed is:

1. A portable exercise platform comprising:

(a) at least one platform section, said at least one platform section having a top surface and a bottom surface;

(b) at least one longitudinal resistance mechanism attached to said at least one platform section with one end of said at least one longitudinal resistance mechanism being anchored to said bottom surface of said at least one platform section, said at least one longitudinal resistance mechanism having a plurality of longitudinal resistance bands, and in use, said plurality of longitudinal resistance bands being movable between a relaxed position and a stretched position;

(c) at least one latitudinal resistance mechanism attached to said at least one platform section with one end of said at least one latitudinal resistance mechanism being anchored to said bottom surface of said at least one platform section, said at least one latitudinal resistance mechanism having a plurality of latitudinal resistance bands, and in use, said plurality of latitudinal resistance bands being movable between a relaxed position and a stretched position; and (d) said at least one longitudinal resistance mechanism being substantially perpendicular to said at least one latitudinal resistance mechanism on said bottom surface of said at least one platform section during use.

2. The portable exercise platform of claim 1 wherein said longitudinal resistance mechanism is a split longitudinal resistance mechanism.

3. The portable exercise platform of claim 1 wherein said latitudinal resistance mechanism includes two sides that are interwoven.

4. The portable exercise platform of claim 1 further comprising retractable handgrips, each handgrip having an extendable-retractable strap that may be engaged or disengaged, said extendable-retractable strap suitable for attaching to at least one of said resistance mechanisms.

5. The portable exercise platform of claim 1 further comprising retractable handgrips, each handgrip having an extendable-retractable strap, each of said plurality of resistance bands of one of said resistance mechanisms suitable for attaching to said extendable-retractable strap.

6. The portable exercise platform of claim 1 further comprising spreader attachment devices and retractable handgrips, each handgrip having an extendable-retractable strap, said resistance mechanisms removably connected to one of said spreader attachment devices, and said extendable-retractable strap removably connected to said one of said spreader attachment devices.

7. The portable exercise platform of claim 1 further comprising spreader attachment devices and retractable handgrips, each handgrip having an extendable-retractable strap, said extendable-retractable strap removably connected to one of said spreader attachment devices, and each of said plurality of resistance bands of one of said resistance mechanisms suitable for attaching to said one of said spreader attachment devices.

8. The portable exercise platform of claim 1, unused resistance band of said plurality of longitudinal resistance bands and said plurality of latitudinal resistance bands being positioned on said bottom surface of said at least one platform section.

9. The portable exercise platform of claim 1, wherein said plurality of longitudinal resistance bands and said plurality of latitudinal resistance bands are substantially coextensive with said bottom surface of said at least one platform section.

10. The portable exercise platform of claim 1, wherein at least a portion of said longitudinal resistance bands disposed on said bottom surface and at least a portion of said latitudinal resistance bands disposed on said bottom surface are substantially perpendicular to each other in both of said relaxed position and said stretched position.

11. A portable exercise platform comprising:

(a) at least one platform section, said at least one platform section having a top surface and a bottom surface;

(b) a resistance mechanism having a first part and a second part;

(c) said first part of said resistance mechanism attached to said at least one platform section, said first part of said resistance mechanism having a first plurality of resistance bands, said first plurality of resistance bands being positioned on said bottom surface of said at least one platform section, one end of said first plurality of resistance bands being anchored to said bottom surface; and (d) said second part of said resistance mechanism attached to said at least one platform section, said second part of said resistance mechanism having a second plurality of resistance bands, said second plurality of resistance bands being positioned on said bottom surface of said at least one platform section, one end of said second plurality of resistance bands being anchored to said bottom surface.

12. The portable exercise platform of claim 11 wherein said first part of said resistance mechanism and said second part of said resistance mechanism together are a split longitudinal resistance mechanism.

13. The portable exercise platform of claim 11 wherein said first part of said resistance mechanism and said second part of said resistance mechanism together are an interwoven latitudinal resistance mechanism.

14. The portable exercise platform of claim 11 further comprising retractable handgrips, each handgrip having an extendable-retractable strap that may be engaged or disengaged, said extendable-retractable strap suitable for attaching to said parts of said resistance mechanism.

15. The portable exercise platform of claim 11 further comprising retractable handgrips, each handgrip having an extendable-retractable strap, each of said plurality of resistance bands of one of said resistance mechanism suitable for attaching to said extendable-retractable strap.

16. The portable exercise platform of claim 11 further comprising spreader attachment devices and retractable handgrips, each handgrip having an extendable-retractable strap, said resistance mechanism removably connected to one of said spreader attachment devices, and said extendable-retractable strap removably connected to said one of said spreader attachment devices.

17. The portable exercise platform of claim 11 further comprising spreader attachment devices and retractable handgrips, each handgrip having an extendable-retractable strap, said extendable-retractable strap removably connected to one of said spreader attachment devices, and each of said plurality of resistance bands of said first and second parts of said resistance mechanism suitable for attaching to said one of said spreader attachment devices.

18. A portable exercise platform comprising:

(a) at least one platform section, said at least one platform section having a top surface and a bottom surface;

(b) a split longitudinal resistance mechanism comprising:

(i) a first part of said longitudinal resistance mechanism being anchored at one end to said bottom surface of said at least one platform section, said first part of said longitudinal resistance mechanism having a first plurality of longitudinal resistance bands; and (ii) a second part of said longitudinal resistance mechanism being anchored at one end to said bottom surface of said at least one platform section, said second part of said longitudinal resistance mechanism having a second plurality of longitudinal resistance bands;

(c) an interwoven latitudinal resistance mechanism comprising:

(i) a first part of said latitudinal resistance mechanism being anchored at one end to said bottom surface of said at least one platform section, said first part of said latitudinal resistance mechanism having a first plurality of latitudinal resistance bands; and (ii) a second part of said latitudinal resistance mechanism being anchored at one end to said bottom surface of said at least one platform section, said second part of said latitudinal resistance mechanism having a second plurality of latitudinal resistance bands; and (d) said split longitudinal resistance mechanism being substantially perpendicular to said interwoven latitudinal resistance mechanism.

19. The portable exercise platform of claim 18, each unused resistance band of said first and second plurality of longitudinal resistance bands and said first and second plurality of latitudinal resistance bands being positioned on said bottom surface of said at least one platform section.

20. The portable exercise platform of claim 18 further comprising retractable handgrips, each handgrip having an extendable-retractable strap that may be engaged or disengaged, said extendable-retractable strap suitable for attaching directly or indirectly to at least one of said resistance bands.

21. The portable exercise platform of claim 18 further comprising spreader attachment devices and retractable handgrips, each handgrip having an extendable-retractable strap, said extendable-retractable strap removably connected to one of said spreader attachment devices, and each of said plurality of resistance bands of said first and second parts of said resistance mechanism suitable for attaching to said one of said spreader attachment devices.

22. The portable exercise platform of claim 18 wherein, in use, each of said resistance bands has a relaxed position and a stretched position, at least part of each of said resistance bands of said split longitudinal resistance mechanism being substantially perpendicular to at least part of each of said resistance bands of said interwoven latitudinal resistance mechanism when said resistance bands are in said relaxed position and said stretched position.

* * * * *